US010267602B2

(12) United States Patent
Carrillo Fuentevilla et al.

(10) Patent No.: US 10,267,602 B2
(45) Date of Patent: Apr. 23, 2019

(54) TARGETS AND TARGET STANDS

(71) Applicant: SOLO OUTDOORS SA DE CV, San Pedro Garza Garcia (MX)

(72) Inventors: Roberto Carrillo Fuentevilla, San Pedro Garza Garcia (MX); Jesus Cantu Rueda, San Pedro Garza Garcia (MX); Jose Lombard Araujo, San Pedro Garza Garcia (MX); Luis Alfredo Montemayor Uzeta, Guadalupe (MX); Jorge Luis Montemayor Garza, San Nicolas de los Garza (MX)

(73) Assignee: SOLO OUTDOORS SA DE CV, San Pedro Garza Garcia (MX)

( * ) Notice: Subject to any disclaimer, the term of this patent is extended or adjusted under 35 U.S.C. 154(b) by 0 days.

(21) Appl. No.: 15/372,387

(22) Filed: Dec. 7, 2016

(65) Prior Publication Data

US 2017/0184377 A1 Jun. 29, 2017

Related U.S. Application Data

(63) Continuation-in-part of application No. 14/959,707, filed on Dec. 4, 2015, now Pat. No. 9,568,286.

(51) Int. Cl.
*F41J 1/10* (2006.01)
*F41J 3/00* (2006.01)

(52) U.S. Cl.
CPC ..... *F41J 1/10* (2013.01); *F41J 3/0004* (2013.01)

(58) Field of Classification Search
CPC ..... F41J 1/00; F41J 1/10; F41J 3/0004
USPC ..... 273/403–408
See application file for complete search history.

(56) References Cited

U.S. PATENT DOCUMENTS 3,087,701 A * 4/1963 Wallace ..... A47C 20/06 248/166
3,109,618 A * 11/1963 Saunders ..... F41J 3/0004 248/464
5,979,899 A * 11/1999 Wilson ..... F41J 3/0004 273/407
6,435,512 B1 * 8/2002 Beckwith, Sr. ..... F41J 1/10 273/403
7,222,860 B2 * 5/2007 Box ..... F41J 3/0004 273/403
9,568,286 B1 * 2/2017 Carrillo Fuentevilla ..... F41J 3/0004
2007/0045965 A1 * 3/2007 Bateman ..... F41J 1/10 273/407

(Continued)

*Primary Examiner* — Mark S Graham
(74) *Attorney, Agent, or Firm* — Ferguson Braswell Fraser Kubasta PC; Elizabeth Philip Dahm; Kelly J. Kubasta

(57) ABSTRACT

A target may allow target practice and/or simulate the shape of one or more animals. In various implementations, a target may include a target body and/or stand. The target body may be capable of receiving shots from arrows and/or ammunition. A target body may include a first aiming zone and a second aiming zone on an opposing surface. In some implementations, the first aiming zone and/or the second aiming zone may be off center. The orientation of the target body may be altered to select an aiming zone of the target body based upon user preference, in some implementations. The overlay may have shape similar to a predetermined animal. The overlay may be replaceable. The stand may support the target body. In various implementations, an overlay may be coupled to the target body and/or stand.

23 Claims, 23 Drawing Sheets

(56) References Cited

U.S. PATENT DOCUMENTS

| | | | | |
|---|---|---|---|---|
| 2008/0265511 | A1* | 10/2008 | Shum | F41J 7/06 273/392 |
| 2009/0134581 | A1* | 5/2009 | Box | F41J 3/0004 273/403 |
| 2009/0256314 | A1* | 10/2009 | Kobett | F41J 1/10 273/407 |
| 2012/0313324 | A1* | 12/2012 | Frickey | F41J 1/10 273/407 |
| 2013/0147119 | A1* | 6/2013 | Matthis | F41J 1/10 273/407 |
| 2014/0091190 | A1* | 4/2014 | Argo | F41B 5/1453 248/397 |
| 2015/0330748 | A1* | 11/2015 | Anzalone | F41J 1/10 273/390 |

* cited by examiner

TARGETS AND TARGET STANDS

CROSS-REFERENCE TO RELATED APPLICATION

The present application is a continuation in part of U.S. application Ser. No. 14/959,707 filed on Dec. 4, 2015 and entitled "Archery Targets," which is incorporated herein by reference for all purposes.

TECHNICAL FIELD

The present invention relates to targets and target stands.

BACKGROUND

Bow hunting is a skilled form of hunting game. Since clean kills with hunting are considered more difficult than with rifles, many bow hunters practice using archery targets. Many current archery targets are formed as life-size animals to provide an archer with realistic hunting conditions. These targets are often three-dimensional, molded foam game animals (e.g., a deer or a bear). However, these targets are expensive (e.g., costly to manufacture due to the size and detail of the target, due to the replacement cost of the entire animal upon repeat use, due to the need for multiple targets to practice different game), difficult to move (e.g., due to the size) and/or can only represent a single animal.

SUMMARY

In various implementations, a target body, an overlay, and/or stand (e.g., frame) may be provided. The target body may be disposed on a stand and a user may attempt to strike the target body with arrows and/or ammunition. An overlay may be coupled to the stand (e.g., frame), the target body, and/or be self-supporting.

In various implementations, an archery target may include a target body with one or more aiming zones. An aiming zone may be associated with one or more vital organ regions of a set of animals. The target block may include aiming zones that are associated with different sets of animals, in some implementations. The target block may be reoriented (e.g., rotated and/or flipped) to reorient an aiming zone and, for example, allow target practice on a different type of animal associated with the reoriented aiming zone.

In various implementations, an archery target may include a target body. The target body may include a width disposed between a first end and a second opposing end. The first end may include a first surface. The first surface may include a first central axis perpendicular to the width of the target body, and a first aiming zone disposed off center with respect to the first central axis of the first surface. The second end may include a second surface. The second surface may include a first central axis perpendicular to the width of the target body and a second aiming zone disposed off center with respect to the first central axis of the second surface. The first aiming zone may protrude from the first surface and/or the second aiming zone may protrude from the second surface.

Implementations may include one or more of the following features. The first aiming zone may correspond to a first set of animals and the second aiming zone may correspond to a second set of animals. The second set of animals may be smaller in size than the first set of animals, and wherein the second aiming zone is smaller in size than the first aiming zone. The orientation of the target body may be adjustable such that the target body may be at least one of rotated or flipped to reorient at least one of the first aiming zone or the second aiming zone of the target body. The first aiming zone may correspond to a vital organ region (e.g., a region that includes at least a portion of vital organ(s) of an animal) of a set of animals. In some implementations, the first surface further may include a second central axis perpendicular to the first central axis of the first surface and perpendicular to the width of the target body. The first aiming zone may be off-center with respect to the second central axis of the first surface. In some implementations, the second surface may include a second central axis perpendicular to the first central axis of the second surface and perpendicular to the width of the target body. The second aiming zone is off-center with respect to the second central axis of the second surface. The first aiming zone and/or the second aiming zone may be replaceable. The archery target may include a mounting frame coupled to the target block to at least partially support the target block, and an overlay similar to at least a portion of an animal. The overlay may be coupled to the target block. The overlay may include a two dimensional representation similar to an animal.

In various implementations, an archery target may include a target body. The target body may include a width disposed between a first end and a second opposing end. The target body may include a first end with a first surface. The first surface may include a first aiming zone, which protrudes from the first surface of the target body. The first aiming zone may include a first size corresponding to a first set of animals. The target body may include a second opposing end with a second surface. The second surface may include a second aiming zone, which protrudes from the second surface of the target body. The second aiming zone includes a second size which may correspond to a second set of animals. The second set of animals may be smaller in size than the first set of animals, and/or the second aiming zone is smaller in size than the first aiming zone.

Implementations may include one or more of the following features. The first surface may include a first central axis perpendicular to the width of the target body, and the first aiming zone may be disposed off center with respect to the first central axis of the first surface. The second surface may include a first central axis perpendicular to the width of the target body, and the second aiming zone may be disposed off center with respect to the first central axis of the second surface. The archery target may include an overlay coupled to the target body. The overlay may be replaceable. The archery target may include a mounting frame coupled to the target body. The mounting frame may allow the target body to be reoriented and the height of target body to be adjusted.

In various implementations, an archery target may include a target body, a mounting frame coupleable to the target body, and a replaceable overlay. The target body may include a width disposed between a first end and a second opposing end. The target body may include a first end with a first surface. The first surface may include a first aiming zone, which protrudes from the first surface of the target body. The first aiming zone may include a first size corresponding to a first set of animals. The target body may include a second opposing end with a second surface. The second surface may include a second aiming zone, which protrudes from the second surface of the target body. The second aiming zone may correspond to a second set of animals. The second set of animals may be smaller in size than the first set of animals and/or the second aiming zone may be smaller in size than the first aiming zone. The mounting frame may at least partially support the target body. The replaceable overlay may be similar to at least a portion of an animal.

Implementations may include one or more of the following features. The mounting frame may include adjustable legs. The mounting frame may be directly coupled to the target body. The archery target may include a mounting strap disposed at least partially around a periphery surface of the target body. The mounting strap may couple the mounting frame and the target body. The mounting strap may allow rotation of the target body. The mounting strap may include pockets. Pocket(s) may receive at least a portion of one or more legs of the mounting frame.

In various implementations, an archery target may include a target body. The target body may include a width disposed between a first end and a second opposing end. The first end of the target body may include a first surface. The first surface may include a first central axis perpendicular to the width of the target body, and a first aiming zone disposed off center with respect to the first central axis of the first surface. The first aiming zone may correspond with a first set of animals, where the first set of animals includes more than one first animal. The second end may include a second surface. The second surface may include a first central axis perpendicular to the width of the target body, and a second aiming zone disposed off-center with respect to the first central axis of the second surface. The second aiming zone may correspond to a second set of animals, where the second set of animals includes more than one second animal.

Implementations may include one or more of the following features. The target body may include more than one position, such as a first position and a second position. When the target body is disposed in the first position the first aiming zone may be associated with a first subset of animals, where the first subset of animals is a portion of the first set of animals. When the target body is disposed in the second position, the first aiming zone is associated with a second subset of animals, where the second subset of animals is a portion of the first set of animals that is different from the first subset of animals. One or more animals may be in the first subset and the second subset of animals, in some implementations. The target body may be rotated from the first position to the second position. The first aiming zone may correspond to a vital organ region associated with the first set of animals and/or the second aiming zone may correspond to a vital organ region associated with the second set of animals, in some implementations.

In various implementations, the target stand may include a target mounting frame. The target mounting frame may be capable of being utilized in more than one orientation, in some implementaions. For example, the target mounting frame may include a target support member that is capable of being used (e.g., residing on the ground) when coupled to a post and legs (e.g., via a base) and/or when coupled to legs such that the legs extend from the target support member. The target support member may include: a first surface that includes a first end and an opposing second end; and an opposing second surface. The second surface may include a post coupling member disposed on the second surface. The post coupling member may allow a post adapted to extend the height of the frame to be coupled to the target support member. The second surface may include one or more strap coupling members extending from the second surface. One or more of the strap coupling members may include an aperture to allow a strap to couple with the strap coupling member. A strap may couple a target body and/or overlay to the target support member, in some implementations. The target support member may include a first side disposed between the first surface and the second surface of the target support member. The target support member may include at least two leg coupling members disposed on the first side. A first leg coupling member may be disposed proximate a first end of the first surface and/or a second leg coupling member may be disposed proximate a second end of the first surface of the target support member. The target support member may be capable of supporting a target body and/or an overlay in at least a first position and a second position. In the first position, each leg of the frame may be coupled at a first end of each of the legs to one of the leg coupling members, and at least a portion of a side of the each of the legs and at least a portion of one or more of the strap coupling members contacts a surface on which the target mounting frame is disposed. In the second position, the target support member may be coupled to legs of the frame via a base that is coupled to the post. The post may be coupled to the post coupling member of the target support member. In the second position a second opposing end of the legs of the target mounting frame contact the surface.

Implementations may include one or more of the following features. The target mounting frame may include a post coupled to the target support member via the post coupling member, and a base. The base may include a brace. The brace may include a post opening adapted to receive at least a portion of the post to couple the post and the base of the frame. The base may include at least three apertures disposed at an angle relative to the target support member, where an aperture receives one of the legs of the frame. At least three legs may each be disposed at least partially in an aperture of the base. A leg may include a first end disposed proximate the base, and an opposing second end adapted to contact the surface on which the frame is disposed. In some implementations, the target mounting frame may include anchoring loop(s). An anchoring loop may be disposed proximate the second end of leg(s). The anchoring loop(s) may couple with an anchor disposed in the surface on which the frame is disposed to inhibit movement of the frame. The height of the post may be adjustable by adjusting the position of the post in the brace. The height of the frame may be adjustable by adjusting the position of the legs in the leg openings in the base. In some implementations, the angle of the leg openings may inhibit movement of the legs from the weight of the frame. In some implementations, the target mounting frame may include fastener openings and first fasteners. A fastener opening may extends through the base into one of the leg apertures. A first fastener may be disposed in a fastener opening such that an end of the first fastener contacts at least one of the legs in a leg opening to inhibit adjustment of the height of the frame by adjusting the height of the leg. The target mounting frame may include second fastener(s). A second fastener may be disposed in an opening extending through the brace into the post opening. The second fastener may contact the post to inhibit adjustment of a height of the frame by adjusting the height of the post. The base may include a first end and an opposing second end. The second end of the base may be more proximate a surface on which the frame is disposed than the first end. The brace of the base may include comprises a conduit that extends through the base such that the brace extends from the first end of the base and extends from the second end of the base. The target mounting frame may be self leveling. The target support member may include a first brace opening disposed proximate the first end of the first surface and a second brace opening disposed proximate the second end of the first surface. The frame further may include at least two brackets, such as a first bracket and a second bracket. The first bracket may include a plurality of coupling openings extending along the first bracket and/or the second bracket may include plurality of coupling openings extending along the second bracket. The target mounting frame may include a flexible overlay. The flexible overlay may include a length and one or more patterns disposed on the length of the flexible overlay. The target mounting frame may include a first roll and a second roll on which the flexible overlay may extend. The first roll may include an opening disposed through the length of the first roll. A first connector may be disposed through the opening of first roll. A first end of the first connector may be coupled to the first bracket via at least one of the coupling openings and/or a second end of the first connector may be coupled to the second bracket via at least one of the coupling openings. The second roll comprises an opening disposed at least partially through the length of the second roll. A second connector may be disposed through the opening of second roll. A first end of the second connector may be coupled to the first bracket via at least one of the coupling openings and/or a second end of the second connector may be coupled to the second bracket via at least one of the coupling openings. The flexible overlay may wrapping around and/or unwrap from the first and/or second roll. The first roll and the second roll may be able to rotate to allow unwrapping of at least a first portion of the flexible wrap from the second roll and wrapping at least a second portion of the flexible overlay around the first roll and/or unwrapping of at least a first portion of the flexible overlay from the first roll and wrapping at least a second portion of the flexible overlay around the second roll, in some implementations. In some implementations, the target mounting frame may include one or more additional overlays. For example, an additional overlay may have a shape similar to at least a portion of an animal. The additional overlay may be coupled to the target body, the frame, and/or be self-supporting. The additional overlay may include at least one aiming zone aperture. At least a portion of the flexible overlay may be accessible via at least one of the aiming zone apertures. In some implementations, the frame may include an overlay that is coupled to the first bracket via one or more of the coupling openings of the first bracket and/or coupled to the second bracket via one or more of the coupling openings of the second bracket. In some implementations, the target mounting frame may include a target body capable of inhibiting passage through the target body of an arrow and/or ammunition. The target body may be coupled to the target support member via one or more flexible connectors and the brackets. The target body may be coupled to at least one loop of the first bracket via at least one flexible connector and the target body may be coupled to at least one loop of the second bracket via at least one other flexible connector. In some implementations, the target mounting frame may include a target body capable of inhibiting passage through the target body of ammunition and may be coupled to the target support member via at least one rigid connector. The target body may include a coupling member. The first end of the rigid connector may be coupled to the first bracket and/or the second end of the rigid connector may be coupled to the second bracket. The rigid connector may be coupled to the coupling member of the target body to allow rotation of the target body. For example, when the ammunition strikes the target body, the target body may rotate about the rigid connector.

In some implementations, a target overlay may be provided. The overlay may be utilized with any appropriate target body and/or stand. The overlay may include a first surface, an opposing second surface, and a plurality of channels disposed between the first surface and the second surface. One or more of the channels may be a filled channel (e.g., a channel at least partially filled with indicator). An indicator filling may be disposed in at least one of the filled channels. A channel may include different or the same indicator filling in different portions of the channel. The overlay may release at least a portion of the indicator filing when at least one of an arrow or ammunition ruptures at least a portion of at least one of the filled channels. In some implementations, the overlay may include at least one aiming zone. An aiming zone may have a shape similar to at least one vital organ, in some implementations. At least a portion of the target overlay may have a shape similar to at least a portion of one or more animals (e.g., head, body, entire animal, etc.).

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Archery targets may be used to improve shooting accuracy, to practice archery, in contests, and/or for sport. In various implementations, an archery target includes a target body with an aiming zone. A user may shoot an arrow with an intention of hitting the aiming zone, in some implementations. The archery target may include a frame and/or overlays. The frame may at least partially support an orientation and/or a height of the target body. The overlay may couple with the frame and/or the target body. The overlay may resemble an animal or portion thereof, in some implementations.

During use, the archery target receives a pointed projectile, such as an arrow. The archery target may be designed to receive and retain at least a portion of an arrow that strikes the arrow with a predetermined minimum force (e.g., the archery target may be able to receive and retain an arrow striking with approximately 86 foot pounds). If the arrow strikes the target body of the archery target, the momentum of the arrow is stopped (e.g., by the foam of the target body). For example, arrows may travel at approximately 40 to approximately 400 feet per second and the archery target may stop the arrow and retain at least a portion of the arrow (e.g., a tip section) in the archery target. The arrow may be retained in the target body until a user removes the arrow. In some implementations, if the arrow strikes an overlay but not the target body, the arrow may pass through the overlay.

Figure 1A:
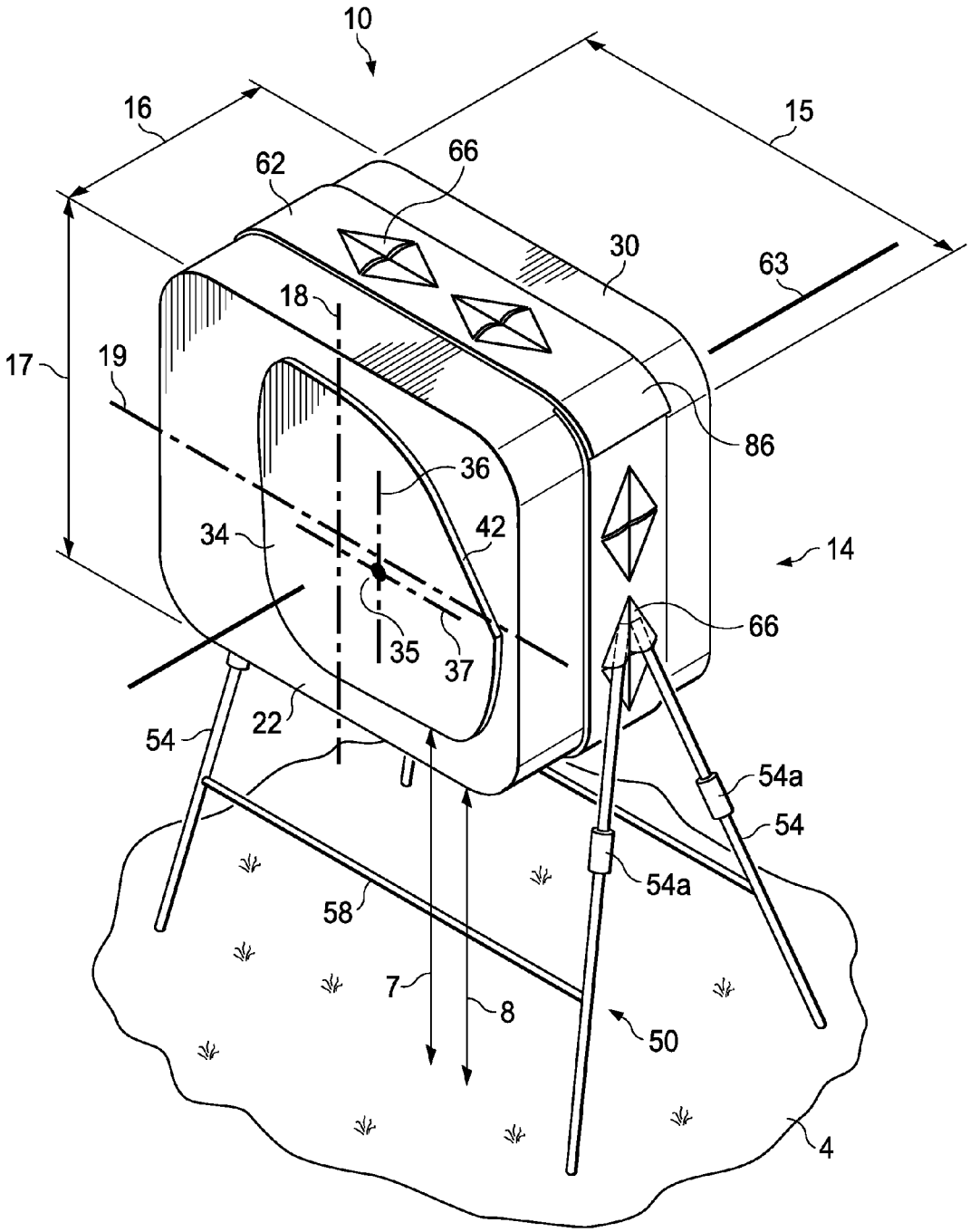
FIG. 1A illustrates a perspective view of an implementation of a first side of an example archery target.

FIG. 1A illustrates an implementation of an example archery target 10. As illustrated, an archery target includes a target body 14 and a mounting frame 54. The target body may include materials and/or a size to quickly stop incoming arrows (e.g., not allow arrows to pass though the target body). The target body may allow arrows to be removed (e.g., pulled out) from the target body 14 without lubricant or a removal device, in some implementations.

The target body 14 may be solid, porous, cellular, any other appropriate structure, or combinations thereof. The target body 14 may include any appropriate material, such as molded polyurethane foam. The target body 14 may be self-healing. The density of the target body may be approximately uniform. In some implementations, the target body may include more than one density across a length, height, and/or width of the target body. For example, a target body may include more than one aiming zone, and one or more of the aiming zones may have a different density than another aiming zone(s).

In some implementations, the target body may include materials (e.g., polyurethane foam) similar in density to one or more parts (e.g., vital organs) of animal(s). By simulating the density of an animal or portion thereof, arrow penetration under hunting conditions may be more closely approximated using the archery target.

The target body may have any appropriate regular or irregular shape. As illustrated, the target body may have a cuboid shape. The target body may be spherical, cylindrical, trapezoidal prism and/or in other appropriate shapes. The edges of the target body may be sharp and/or rounded.

The target body 14 may have a length 15, a width 16, and a height 17. The target body 14 may include a first center axis 18 approximately perpendicular to the length 15 and approximately parallel to the height 17. The target body 14 may also include a second center axis 19 approximately perpendicular to the height 17 and approximately parallel to the length 15.

The target body 14 may include a first surface 22, at a first end of the target body, and an opposing second surface 26, at a second opposing end of the target body. The target body 14 may include one or more other surfaces between the first end and the second end of the target body. The target body may include a peripheral surface 30 extending at least partially around the target body 14 and between the first end and the second end of the target body.

The first surface 22 and/or the second surface 26 may include aiming zones. The aiming zones may be the primary target areas in which arrows are shot, in some implementations. For example, the aiming zone may represent a vital organ region of an animal. A vital organ region may be an area of a predetermined animal that includes at least a portion of one or more vital organs.

The aiming zone may include one or more of the same materials or different materials than the target body. For example, the aiming zone may include polyurethane foam. An aiming zone that protrudes from a surface of the target may be formed by adding additional layers of material, by carving out regions proximate the aiming zone, by injection molding the target body with the protrusions formed in the mold, thermomolding the target body with protrusions formed in the mold, and/or any applicable process.

As illustrated, the target body 14 may include a first aiming zone 34 on the first surface 22 of the target body and a second aiming zone 38 on the second surface 26 of the target body. An aiming zone may protrude at a height 42 from a surface of the target body 14. For example, the first aiming zone 34 may be a protrusion extending from the first surface 22 and the second aiming zone 38 may be a protrusion extending from the second surface 26.

In some implementations, the aiming zone (e.g., the first aiming zone and/or the second aiming zone) may be off-center with respect to the target body. An aiming zone may have a centroid 35 and a central axis 36 passing through the centroid and parallel to a respective the central axis of the target body. The aiming zone may be off-center with respect to the first central axis 17 of the target body 14 and/or off-center with respect to the second central 18 axis of the target body. For example, a first central axis of the aiming zone may not be the same as the first central axis of the target body. As illustrated, the first central axis of the aiming zone is disposed adjacent to (e.g., to the right side) of the first axis of the target body. In some implementations, a second central axis 37 of the aiming zone may not be the same as the second central axis 18 of the target body 14. As illustrated, the second central axis 37 of the aiming zone is disposed adjacent to (e.g., below) the second axis of the target body 14. In some implementations, an aiming zone may be off-center with respect to the target body and a greater proportion of the volume of the aiming zone may be disposed a first quadrant of the target body than at least one other quadrant (e.g., a target body is divided into quadrants by the first and the second central axes).

Utilizing a target body with an aiming zone off-center may allow the position of the aiming zone relative to the ground (e.g., and/or the user) to be adjusted. For example, if a target body 14 is rotated (e.g., 90 degrees, 180 degrees, and/or 270 degrees), a height 7 of an aiming body from the ground may be adjusted. As illustrated in FIG. 1A, if the target body 14 is rotated counterclockwise, the height of the aiming zone 34 from the ground will be increased. If the target body 14 is rotated clockwise, the height 7 of a portion of the aiming zone may be increased and a height of another portion of the aiming zone may not be increased (e.g., due to the shape of the aiming zone). In some implementations, adjusting the orientation of the target (e.g., rotating, coupling via a different pocket, etc.) may adjust the height 8 of the target body 14 from the ground 4. Thus, user satisfaction may be increased since different target heights (e.g., corresponding to different types of animals or target practice) may be allowed with a single target body. For example, a first orientation of the target body may be associated with an aiming zone for moose vital organs, while a second orientation of the target body (e.g., 90 degree rotation clockwise, 90 degree orientation counterclockwise, 180 degree rotation, 270 degree rotation) may be associated with an aiming zone for deer vital organs.

In some implementations, the target body may include different or similar aiming zones positioned on opposing surfaces of the target body. By utilizing a target body with different aiming zones (e.g., different shapes, different sizes, and/or different orientations), the target body may allow more types of target practice, such as practicing aiming on different animals. For example, a first aiming zone may be associated with a first set of animals (e.g., large animals) and/or may be larger than a second aiming zone that may be associated with a second set of animals (e.g., smaller animals that the first set of animals). In some implementations, first and/or second aiming zones may be disposed off-center (e.g., relative to one or more central axes of the target body). Thus, when the target body is rotated, the height and/or shape (e.g., orientation of the shape may adjust) of the first aiming zone and the second aiming zone may be adjusted. By adjusting the height and/or shape of the aiming zone, the set of animals associated with the aiming zone may be changed. Thus, a user may be able to practice on more animal representations using the same target block and user satisfaction may increase.

In some implementations, a target block may have more than one position in which it may be utilized. For example, a target block may be approximately rectangular with rounded corners and include a first position, second position, third position, and/or fourth position. The target body may be rotated to adjust between the positions of the target block (e.g., the target block may be rotated 90 degrees to adjust between a first and second position). In one or more of the positions, the set of animals associated with the aiming zones may change. For example, when the target block is in a first position, the first aiming zone may be associated with a first subset of first animals and/or the second aiming zone may be associated with a first subset of first animals. When the target block is in the second position, the first aiming zone may be associated with a second subset of first animals and/or the second aiming zone may be associated with a second subset of second animals. The first subset of first animals and the second subset of first animals may be portions of the first set of animals that are associated with the first aiming zone. In some implementations, the first subset and the second subset of first animals are different but may include one or more of the same animals. The first subset of second animals and the second subset of second animals may be portions of the second set of animals that are associated with the second aiming zone. In some implementations, the first subset and the second subset of second animals are different but may include one or more of the same animals. Thus, by rotating the target block, the user may be capable of practicing shooting of different sets of animals with the same target block. The user satisfaction may increase based on decreased costs and/or decreased storage space (e.g., the user may not need to buy a plurality of target blocks; and/or increased enjoyment (e.g., variations may increase satisfaction and decrease boredom).

Figure 1B:
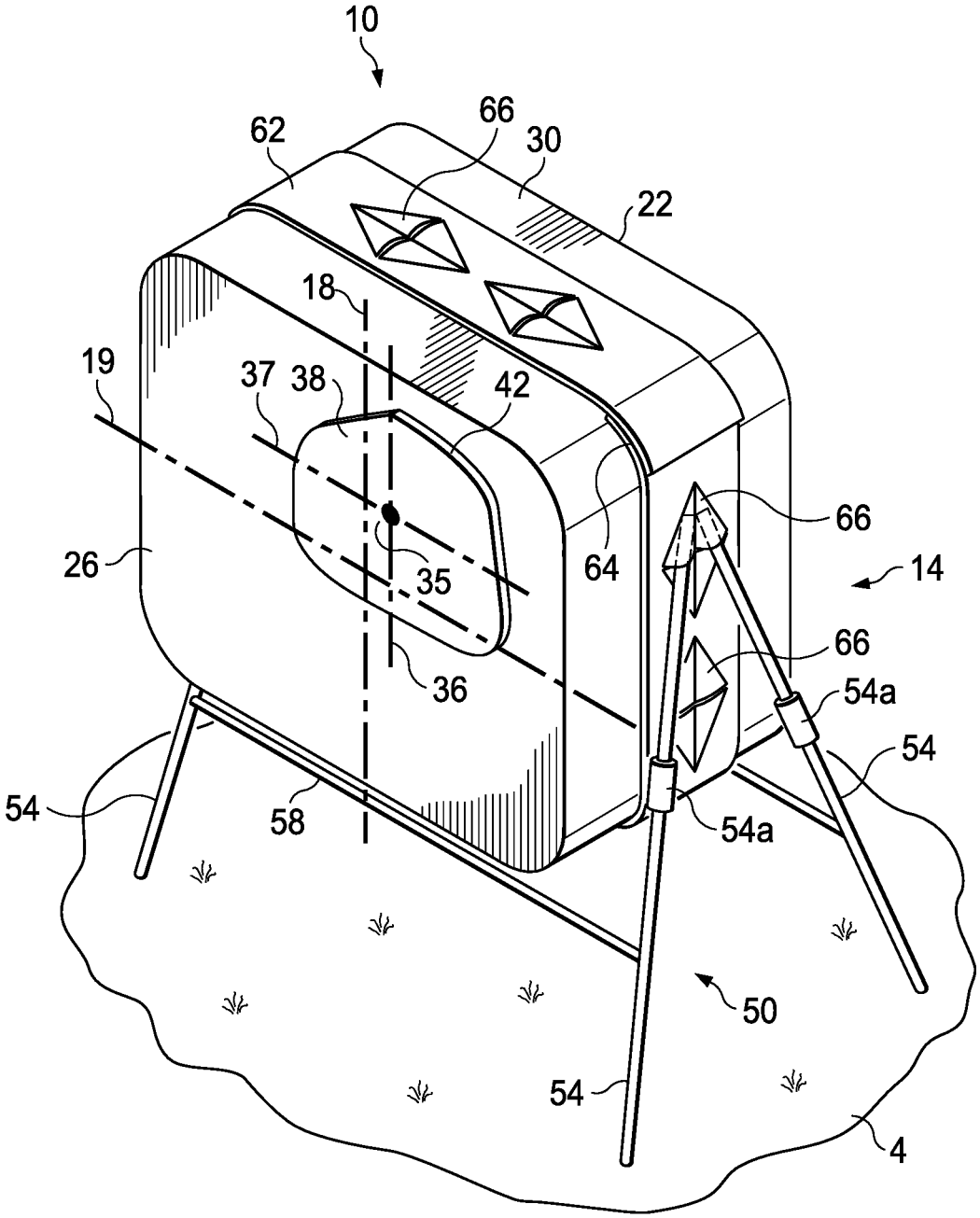
FIG. 1B illustrates a perspective view of an implementation of a second side of the example archery target, illustrated in FIG. 1A.

As illustrated in FIGS. 1A and 1B, the target body 14 includes a first surface 22 with a first aiming surface 34 and a second opposing surface 26 with a second aiming zone 38. The first surface 22 may include a relatively large aiming zone 34 (e.g., compared to the second aiming zone 38), which may be shaped to correspond with the size and/or location of vital organs of corresponding to larger game animals, and the second surface 26 includes a relatively small aiming zone 38 (see FIG. 1B) shaped to correspond with the size and/or location of vital organs of smaller game animals. The aiming zone(s) (e.g., first aiming zone 34 and/or second aiming zone 38) includes a height 42 so that the aiming zone(s) protrude from a surface of the target body. As illustrated, each aiming zone 34, 38 includes a shape corresponding to a vital organ region of a predetermined set of animals (e.g., one or more animals). For example, an first aiming zone 34 that is relatively large in size, as illustrated in FIG. 1A, may correspond to the vital organ region of large game animals such as deer, elk, goats, moose, lions, bears, and/or buffalo. A second aiming zone 38 that is smaller in size (e.g., when compared to first aiming zone 34), as illustrated in FIG. 1B, may correspond to the vital organs region of smaller game animals (e.g., lower to the ground and/or smaller in size), such as fox, turkey, coyote, raccoon, and/or javelina.

Although FIGS. 1A and 1B illustrate a first aiming zone that larger is than a second aiming zones, other configurations may be utilized as appropriate. For example, a first aiming zone may be smaller than the second aiming zone. The first aiming zone and the second aiming zone may be approximately the same size. In some implementations, the first aiming zone and/or the second aiming zone may include more than one protrusion (e.g., to represent particular vital organs and/or regions of an animal; to represent targets for archery competitions; and/or to increase adjustability of the target body).

In some implementations, user satisfaction may be increased by allowing a user to practice archery on large and/or small game animals using the same target body (e.g., since multiple archery targets may not need to be purchased, since targets may not need to be moved to make room for additional targets, etc.). For example, a user may reverse the target body 14 on a mounting frame 50 to select the aiming zone 34 as the active target (FIG. 1A) or the aiming zone 38 (FIG. 1B) as the active target. As shown in FIG. 1A, when compared to FIG. 1B, the target body 14 is positioned (e.g., on the mounting frame 50) at a location that is lower to the ground than as shown in FIG. 1B.

In some implementations, the archery target may utilize a mounting frame in conjunction with the target body. The mounting frame 50 may couple to the target body 14 to at least partially support the target body in a position. The mounting frame 50 may have any appropriate size and/or shape. The mounting frame 50 may be adjustable (e.g., height, width, length) to accommodate different positions, different target bodies, and/or different orientations of the target body, for example. As illustrated in FIGS. 1A and 1B, the mounting frame 50 may include one or more legs 54. The legs of the mounting frame may rest upon the ground and/or may be staked into the ground (e.g., via tapered leg ends, footings, etc.). The legs of the mounting frame may include one or more height-adjustable legs 54 with a height adjustment mechanism 54*a* (e.g., ratcheting legs, crank adjustable legs, slot and tab adjusting legs, etc.). The legs 54 of the mounting frame may have any appropriate size and/or shape (e.g., tubular). In some implementations, the legs 54 of the mounting frame 50 may be disposed to extend downwardly and away from each other at a fixed angle and/or engage with the ground 4. The mounting frame 50 may include cross member(s) 58, which extend between the legs 54 to increase stability of the mounting frame 50 (e.g., when compared with a mounting frame without cross members). The cross member(s) 58 may be coupled to the legs 54 by any appropriate means (e.g., welding, bolting, etc.).

The mounting frame 50 may be coupled to the target body to inhibit damage to arrows due to contact with the mounting frame. For example, the mounting frame may have a shape and/or couple with the target body such that the components of the frame do not reside in the path between an aiming zone and an arrow from a user. The mounting frame may couple (e.g., directly or indirectly) with the target body on one or more peripheral surfaces 30 of the target body, in some implementations. As illustrated in FIGS. 1A and 1B, a mounting strap 62 may be utilized to couple the target body 14 and the mounting frame 50. For example, the mounting strap 62 may be disposed to wrap at least partially around the peripheral surface 30 of the target body 14 and at least partially support the target body 14 on the mounting frame 50. In some implementations, the mounting strap 62 contacts the peripheral surface 30 and tautly wraps around the peripheral surfaces of the target body. In some implementations, ends of the mounting strap 62 may couple to proximate each other via fasteners 64 such as (e.g., by hook and loop fastening such as Velcro®, snap fastening, buttons, and/or various suitable mechanisms).

In some implementations, the mounting strap may facilitate the adjustment of the orientation of the target body. For example, the mounting strap may include pockets 66. The pockets receive at least a portion of the mounting frame (e.g., at least a portion of leg(s)). As illustrated in FIGS. 1A and 1B, an outer surface of the mounting strap 62 may include one or more groups of mounting pockets 66. The mounting pockets 66 may be disposed at approximately equidistant positions along the length of the mounting strap 62.

In some implementations, a mounting pocket 66 may include a material such as pliable sheet material. The mounting pocket 66 may be any suitable size and/or shape (e.g., square, triangle, other regular polygon shaped and/or irregularly shaped). Mounting pocket(s) 66 may be coupled to (e.g., via glue, stitches, staples, etc.) and/or formed in (e.g., integral) the outside surface of the mounting strap 62. The mounting pocket 66 may include a closed end and an open end, in some implementations, which are arranged to receive leg(s) 54 of the mounting frame 50. In some implementations, a mounting pocket is sized and/or shaped to receive, in the mounting pocket, at least a portion of leg(s) 54 of a mounting frame 50. By utilizing mounting pockets 66 at different locations along the mounting strap 62, the target body 14 may be supported upon the mounting frame 50 in an elevated position (FIG. 1A), in a lowered position (FIG. 6) that is closer to the ground, and/or in a variety of other appropriate positions.

The mounting pockets 66 may be arranged in groups (e.g., groups of four pockets per group) with one pair of mounting pockets 66 facing an opposing pair, as illustrated in FIGS. 1A and 1B. Thus, the target body 14 may be, for example, flipped and mounted to the mounting stand 50 via the opposing pair of mounting pockets in the group. By utilizing multiple mounting pockets and/or groups of opposing mounting pockets the target body may be disposed in any one of multiple orientations.

Figure 2:
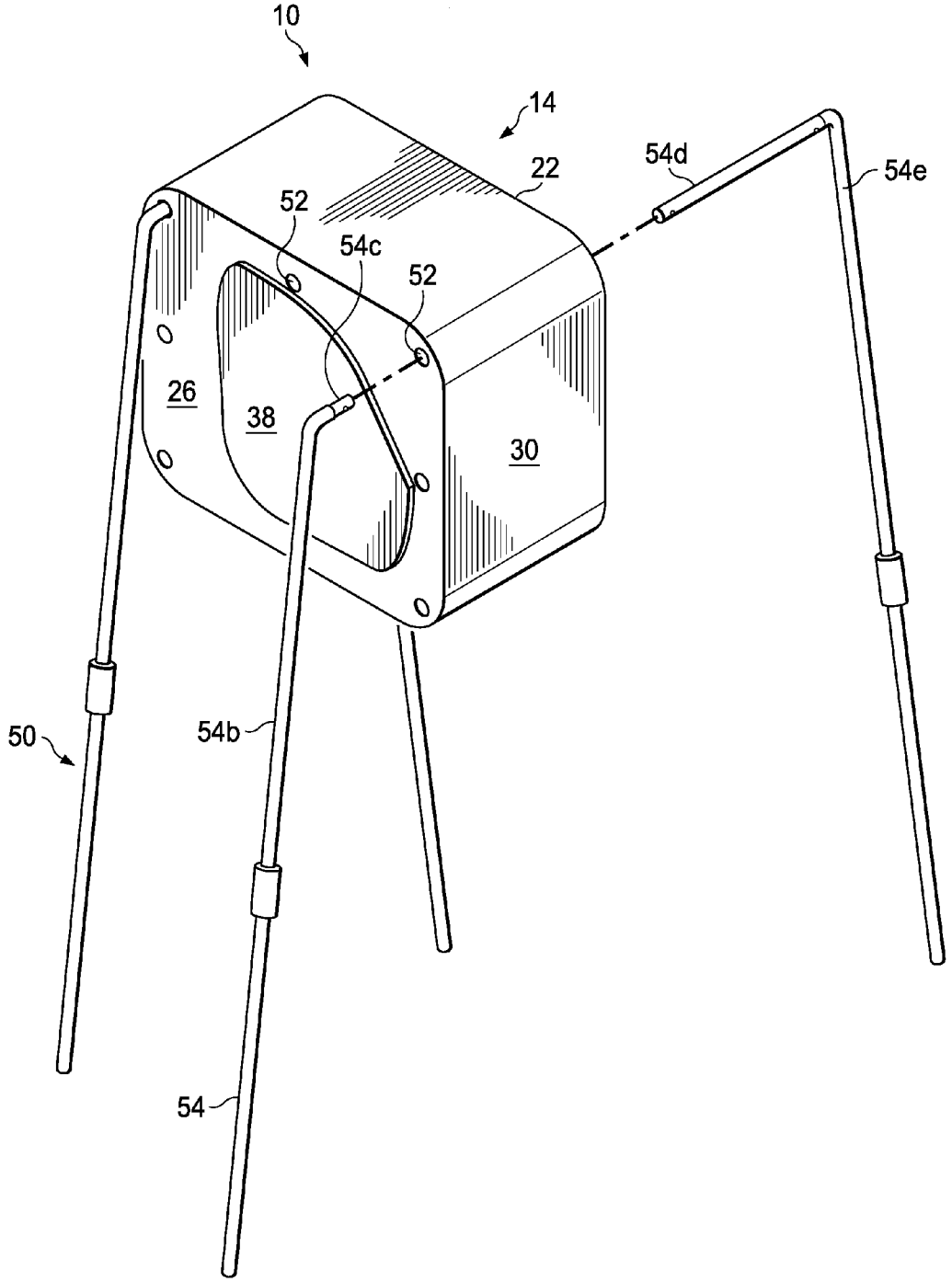
FIG. 2 illustrates a perspective view of an implementation of an example archery target.

In some implementations, the mounting strap may include leg straps that extend from the mounting strap and couple with and/or around leg(s) of the mounting frame. In some implementations, the mounting strap may couple to the target body directly, indirectly (e.g., via hook and loop, clips, snap fastening, screws, and/or other appropriate fasteners) or a combination thereof. FIG. 2 illustrates an implementation of an example archery target in which the mounting frame is directly mounting to the target body. The target body 14 includes openings 52 through the target body. An opening 52 may receive at least a portion of leg(s) 54 of the mounting frame 50. As illustrated, two opposing legs be disposed at least partially in an opening 52 and may couple to each other to at least partially support the target body 14. The first leg 54*b* may include a portion 54*c* that can be disposed in a hollow portion 54*d* of the second opposing leg 54*e*, in some implementations. In some implementations, the legs may couple via fasteners (e.g., bolts through an opening in a leg, threaded legs, etc.)

The archery target may include one or more overlays. The overlay may include any appropriate material, such as animal skin, synthetic animal skin, plastic (e.g., polypropylene), polymer, foam, cardboard, or combinations thereof. The overlay may be a layer coupled to the target body, mounting strap, and/or mounting frame. In some implementations, the overlay maybe coupled directly to the target body and a frame may not be utilized to support the target body (e.g., the target body may be placed on the ground, on a fence, in a tree, and/or in other appropriate locations). The overlay may resemble a portion of an animal (e.g., skin, fur, coloring, pattern, etc.) to provide a more simulated hunting experience for a user, for example. The overlay may be self-healing. An overlay may be replaceable. For example, a user may replace the overlay with a similar or different overlay (e.g., after prolonged use, after damage of an overlay, to practice a different animal, based on external environmental factors, etc.).

In some implementations, the overlay may include a 2 dimensional (2D) representation of an animal or portion thereof. For example, the overlay may include a 2D deer, moose, fox, or other appropriate animal. In some implementations, the overlay may include a 3D animal or portion thereof. The target block may be positioned in the 3D animal overlay and may be repositioned. For example, the target block may be positioned and/or secured in a first position (e.g., to practice aiming on a first vital organ associated with a first aiming zone); then, the user may reposition and/or secure the target block (e.g., by rotating, flipping or otherwise reorienting the target block) to practice aiming on a second vital organ associated with a second aiming zone or with the first aiming zone in a second orientation. In some implementations, the target block and/or portions thereof (e.g., aiming zone(s)) may be replaceable in the 3D overlay. For example, a first target block may utilized with a 3D overlay and a user may remove the first target block and replace it with a second target block (e.g., to practice on a different aiming zone, to replace a worn or damaged target block, etc.). In some implementations, a first target block may utilized with a 3D overlay and a user may remove one or more first aiming zones from the first target block and replace it with one or more second aiming zones (e.g., to replace a worn or damaged target block). The mounting frame may be coupled to and/or integral with the 2D or 3D overlay.

The overlay may be coupled to the target body in some implementations. For example, a strap may couple the overlay to the target body, fasteners (e.g., screws, brads, tabs, etc.) may couple the overlay to the body, etc. In some implementations, the overlay may frictionally couple with (e.g., be retained by) the target body.

In some implementations, the archery target may include a plurality of replaceable overlays. The replaceable overlays may be associated with the same, similar, and/or different animals. For example, one or more overlays in a set may each be shaped in the form of an animal. A user may select an overlay based on user preference during use the archery target.

Figure 3:
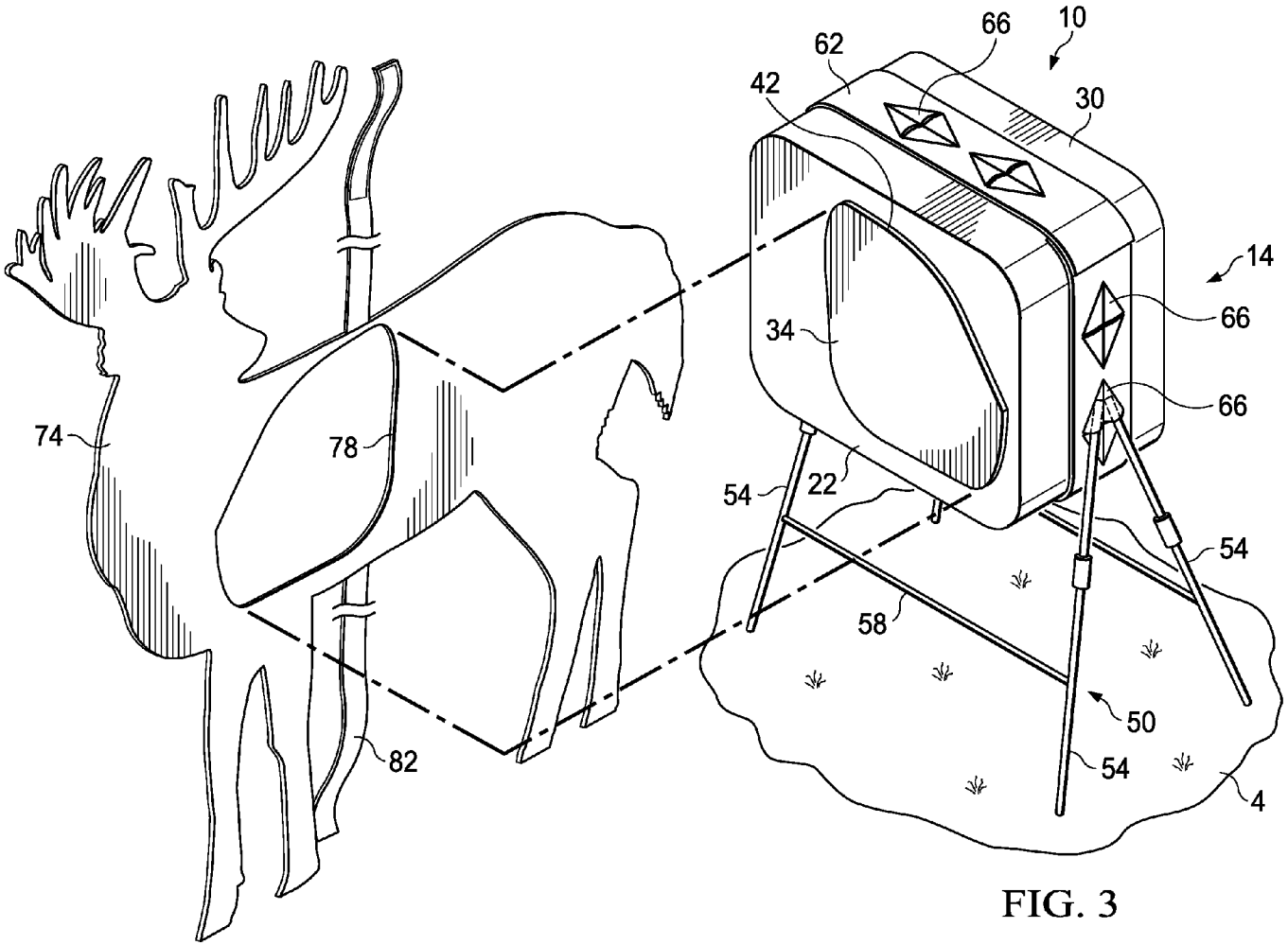
FIG. 3 illustrates a partially exploded perspective view of an implementation of an example archery target.
Figure 4:
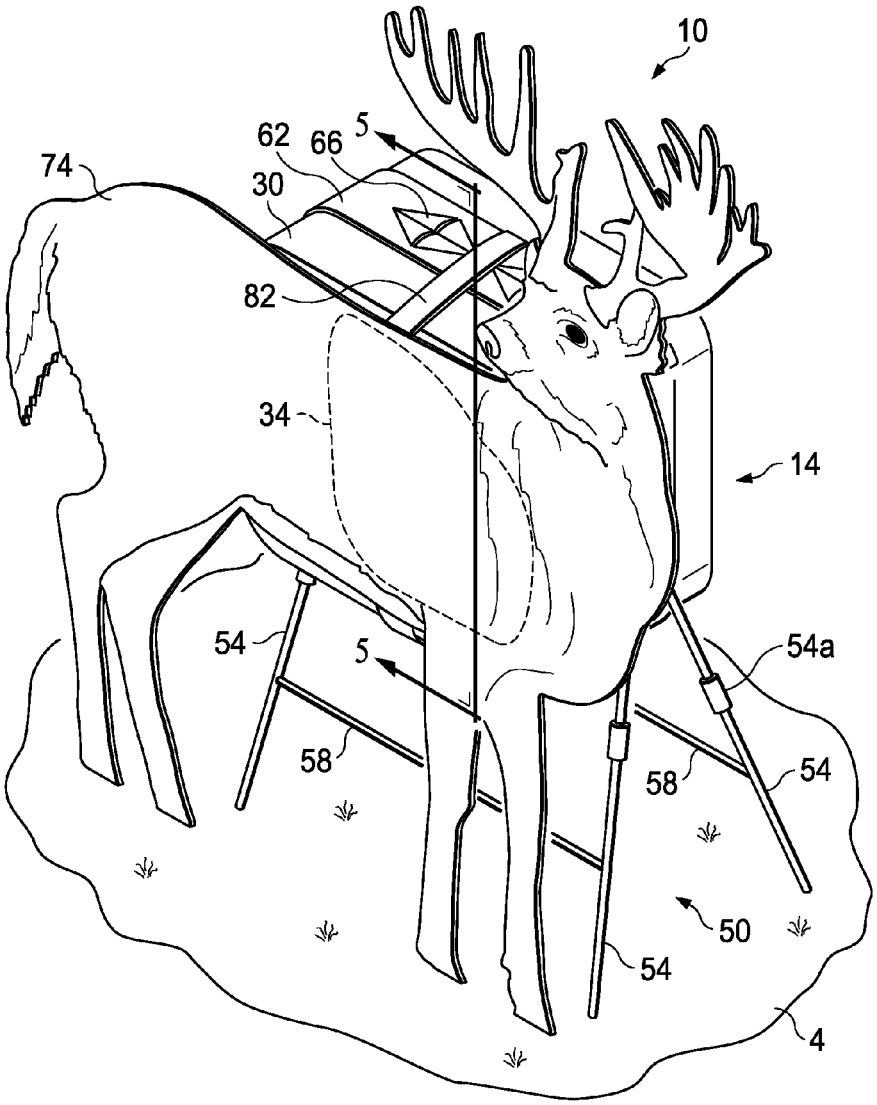
FIG. 4 illustrates a perspective view of an implementation of the example archery target illustrated in FIG. 3.

In some implementations, an overlay may include one or more aiming zone apertures. An aiming zone aperture may allow at least a portion of the aiming zone of the target block to be visible to a user. For example, at least a portion of the aiming zone of the target block may be disposed in and/or protrude through the aiming zone opening of the overlay. As illustrated in FIGS. 3 and 4, aiming zone aperture 78 may be extend through the overlay and be positioned such that at least one aiming zone of a target block may be positioned in the aiming zone aperture. Allowing the aiming zone to be visible and/or accessible via at least one aiming zone aperture of the overlay may reduce wear on the overlay and/or facilitate visualization of a target for aiming (e.g., since the aiming zone may be more apparent without the overlay covering at least a portion of the aiming zone).

Figure 6:
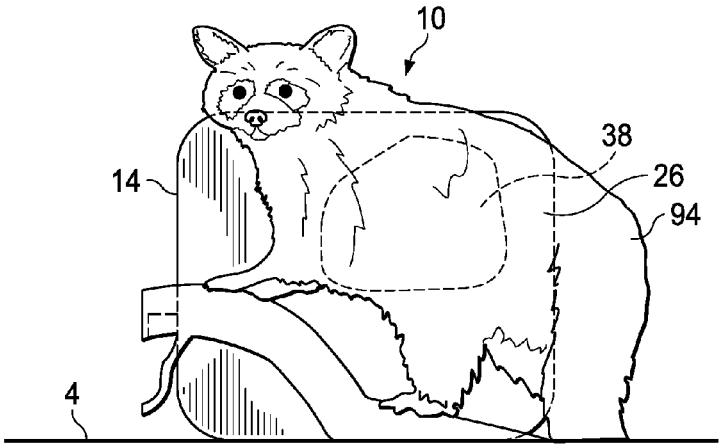
FIG. 6 illustrates a front view of an implementation of an example archery target.

In some implementations, the overlay may cover at least a portion of one or more aiming zones of a target block. As illustrated in FIG. 6, the overlay may cover at least a portion of the target block that includes the aiming zone. In some implementations, the protrusion of the aiming block from the target block may be visible to a user even when covered with an overlay (e.g., the aiming zone may protrude to cause displacement of the overlay) and/or may be apparent to a user when touching the archery target to determine if arrows pierced the aiming zone and/or when removing the arrow(s). (e.g., by feeling the aiming zone protruding from the target block).

In some implementations, during use, a user may adjust an orientation of a target body and/or a position (e.g., height, length, and/or width) of the mounting frame based at least partially upon the type of game animal to be practiced upon. For example, the user (e.g., a bow hunter and/or instructor) may elevate or lower the target body 14. The user may rotate the target body 14 (e.g., along a rotational axis 63, first central axis 17, and/or second central axis 18) through four incremental 90 degree orientations to select one of at least two landscape orientations or one of at least two portrait orientations. In some implementations, different orientations of the aiming zone(s) may correspond with vital organ regions of different game animals.

Figure 7:
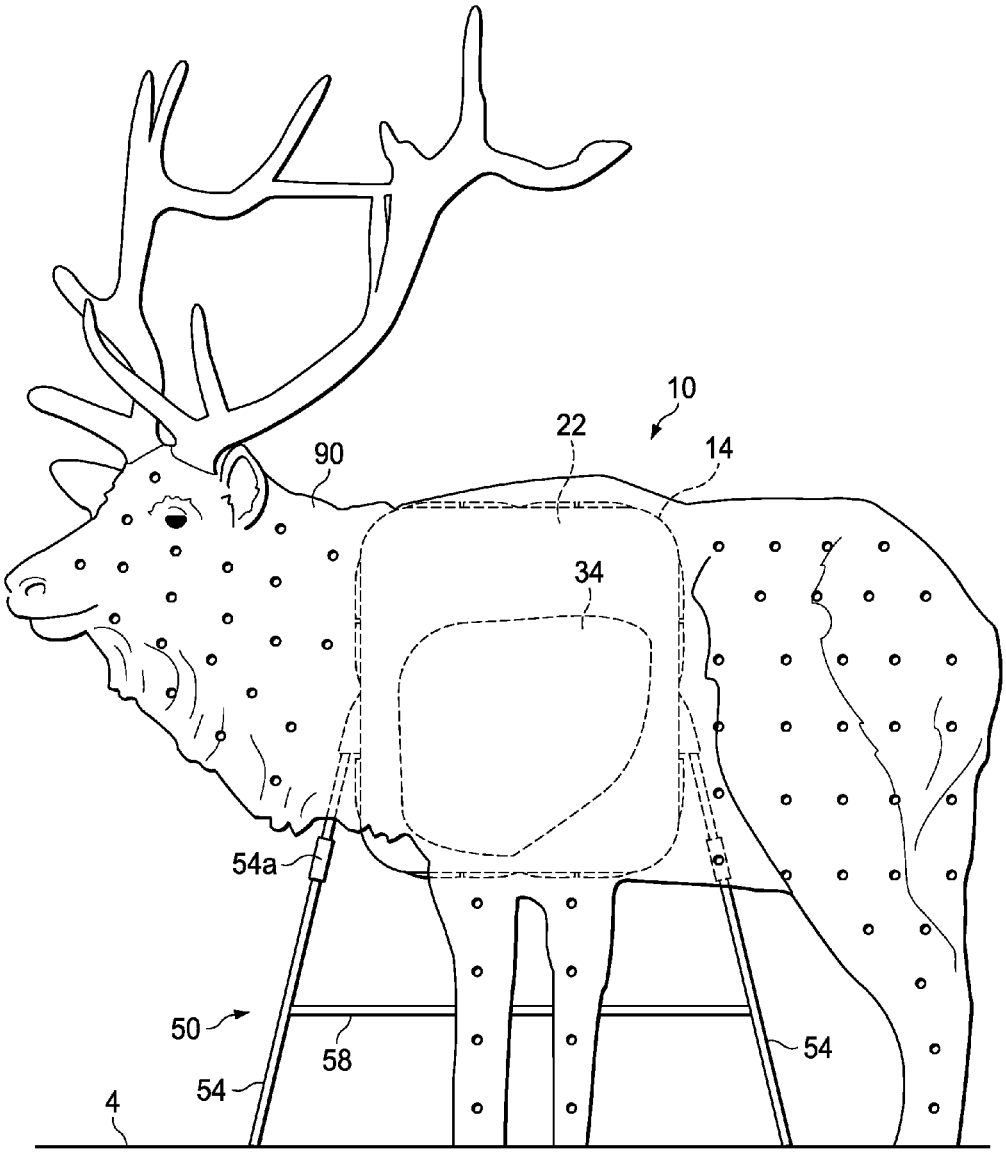
FIG. 7 illustrates a front view of an implementation of an example archery target.

In some implementations, the aiming zones 34, 38 may be located off-center so that as the target body is placed in different orientations, the aiming zones 34 change in position and orientation. For example, referring to FIG. 1A, the target body 14 may be situated in a first landscape position where the aiming zone 34 is positioned to correspond with the location of the vital organs of a deer. The target body 14 may be rotated by approximately 90 degrees counterclockwise from the first landscape position to a first portrait position, as illustrated in FIG. 7, wherein the aiming zone 34 corresponds with the location of the vital organs of an elk. The target body 14 may be rotated through two additional 90 degree increments to reposition the target body 14 to a second landscape and to a second portrait position wherein the aiming zone 34 corresponds with the location of vital organs of other large game animals. In some implementations, as illustrated in FIG. 6, the target body 14 may be reversed (e.g., relative to FIG. 1A) to make the aiming zone 38 the active target, which is selected by the user. The target body 14 may be rotated to a landscape position wherein the aiming zone 38 corresponds with the location of vital organs of a raccoon or other small game animals.

In some implementations, a target block may be able to represent vital organ areas (e.g., via the aiming zones) for a plurality of animals based on the orientation of the target block. For example, the height of the target block from the ground and/or the height of the aiming from the ground may be adjusted by rotating the target. The height of the aiming zone from the ground may be associated with a group of animals, and so rotating the target block to adjust the height of the aiming zone from the ground may adjust the group of animals with which the aiming zone is associated. In some implementations, rotating the target block may adjust orientation of the shape of the aiming zone and may adjust the animals associated with the adjusted target block.

In some implementations, an aiming zone may be associated with a set of animals, such as large game (e.g., standing bear, moose, elk, and/or buffalo), medium game (e.g., sheep, goat, deer, and/or antelope), small game (e.g., javelina, coyote, turkey, and/or bobcat), and mini game (e.g., rabbit, squirrel, raccoon, and/or prairie dog). A target may include an aiming zone on each of two opposing sides. The aiming zones may represent two different sets of animals, in some implementations. For example, a first aiming zone may be associated with large game and a second aiming zone may be associated with small game. A first aiming zone may be associated with mini game and a second aiming zone may be associated with small game, in some implementations. In some implementations, rotation of an aiming zone may also alter the set of animals associated with the aiming zone. For example, if a first aiming zone associated with large game is rotated 90 degrees clockwise, it may be associated with small game; and/or if a second aiming zone is associated with small game is rotated 90 degrees clockwise, it may be associated with medium game.

In some implementations, overlay may cover a target block. The target block may protrude so that at least a portion of the target block is visible to user through the overlay. In some implementations, the overlay may include an aperture in which the target block is at least partially disposed (e.g., at least a portion of an aiming zone may extend through and/or be disposed in the aperture).

In some implementations, the target body and/or the overlay may be self-healing. The target body may enable the target body to at least partially withstand a plurality of arrow punctures and arrow withdrawals (e.g., the target body may be used repeatedly over a time period). The overlay may include one or more layers, in some implementations. For example, the overlay may include a self-healing layer and at least one other layer (e.g., polypropylene, foam, etc.). In some implementations, the overlay may reduce the speed of an arrow passing at least partially through the self-healing layer.

In various implementations, one or more components of the archery target may be replaced. For example, the overlay, the mounting frame, the target body, the aiming targets, and/or portions thereof may be replaced. As archery targets are repeatedly used, overlays may wear prior to, concurrent with, and/or after the target block. Allowing replacement of the overlay separate from other components may decrease costs associated with use of the archery target and/or increase the lifetime of the overall archery target. In some implementations, the target block and/or portions thereof (e.g., aiming targets) may be replaced. For example, an extra layer of foam may be added to the archery target (exterior and/or an interior addition) or portions thereof. In some implementations, a leg of the frame may break, and by allowing replacement of a mounting frame or portions thereof, the lifetime of the target block may be extended and/or costs associated with use may be decreased (e.g., since the broken part may be replaced and working parts may be salvaged).

In some implementations, adhesive pasters may be utilized with the overlay. For example, holes may exist in an overlay after shooting at the overlay and/or target body. Adhesive paster(s) may be applied over the hole in the overlay to extend the life of the overlay (e.g., to repair the overlay and/or increase the aesthetic of a used overlay). Adhesive pasters may include adhesive pasters commercially available from Birchwood Casey as Shoot N-C® (Eden Prairie, Minn., USA). Adhesive pasters have a first side with an adhesive surface (e.g., peel and stick) and a second opposing side. The second opposing side may be a color similar to the target body and/or overlay. In some implementations, the adhesive pasters may include one or more indicator fillings (e.g., gels, powders, etc.) disposed in the adhesive paster such that when an adhesive paster is struck (e.g., by ammunition and/or arrows) at least a portion of the indicator filling is revealed. The indicator filling may have a color different than the target body and/or overlay such that the release of the indicator filing may be easily identifiable. Utilizing an indicator filing may increase enjoyment and/or facilitate identification of a shot.

In some implementations, one or more of the aiming zones may be replaceable. For example, as a user strikes arrows into the aiming zone, the aiming zone may have greater wear than other portions of the target block (e.g., other aiming zones and/or other portions of the target block). The user may replace the aiming zone(s) with greater wear to allow further use of the same target block. By allowing replacement of an aiming zone of the target block, the lifetime of the target block may be extended (e.g., when compared with a target block without replaceable aiming zone(s)). User satisfaction may be increased since less waste may be created (e.g., since parts that are worn are recycled or thrown away rather than the whole target block), operational costs may be decreased (e.g., since worn parts are replaced rather than the entire target block, etc.

In some implementations, to allow the aiming zones to be replaceable the target block may allow removal and replacement of the aiming zones. For example, the target block may include one or more apertures to receive an aiming zone. The aperture(s) of the target block may extend at least partially through a width of the target block. An aiming zone may be received by an aperture and coupled to the target block. For example, the aiming zone my frictionally fit in the aperture of the target block (e.g., the aperture may have a size and shape to receive an aiming zone). The aiming zone may be at least partially disposed in an aperture and/or coupled (e.g., glued, secured via hook and loop fastener, secured via snap coupling, etc.) to at least a portion of the target block, in some implementations. In some implementations, an aperture may be sized and/or shaped to receive a predetermined aiming zone (e.g., large animal vital organ zone, small animal vital organ zone, etc.).

In some implementations, the overlay may be utilized with the described stands without a target body. For example, the overlay may be directly coupled to one of the described stands.

Although implementations of the target body have been described as including a first aiming zone and a second aiming zone. In some implementations, the target body may include one or more additional aiming zones disposed on the same surface as the first aiming zone and/or a different surface (e.g., portion of peripheral surface and/or same surface as the second aiming zone). In some implementations, the first aiming zone and/or the second aiming zone may include a set of one or more aiming zones.

In some implementations, more than one target body may be used in an archery target. For example, an overlay may be coupled (e.g., directly or indirectly) to more than one target body. In some implementations, an archery target may include a mounting frame capable of coupling to more than one target body. For example, a plurality of target bodies may be coupled to the mounting frame to allow a user to practice on multiple target bodies (e.g., corresponding to different animals or the same animals) and/or to allow a plurality of users to practice on a plurality of target bodies (e.g., the same or different target bodies in the same or different orientations).

In some implementations, overlays may include openings to allow air to pass, as illustrated in FIG. 7. The openings to allow air to pass may be disposed across the entire overlay or portion(s) thereof. For example, the overlay may include a mesh. The openings to allow air to pass may be the openings or voids in the mesh. The openings to allow air to pass in the overlays may include any appropriate shape and/or size. For example, the openings to allow air to pass may be slits in the overlay. Wear due to weather (e.g., wind gusts) and/or wear due to entry of arrows (e.g., from stretching the overlay upon entry of the arrow) may be reduced (e.g., compared to overlays without openings to allow air to pass). In some implementations, the overlays may not include openings, as illustrated in FIG. 6.

In various implementations, other stands may be utilized in combination with the described archery target body and/or other target bodies (e.g., target bodies for archery and/or ammunition). In some implementations, a target stand may be utilized that is adjustable. For example, a target can be adjusted for height, width, type of target body, and/or attachment manner.

Figure 8A:
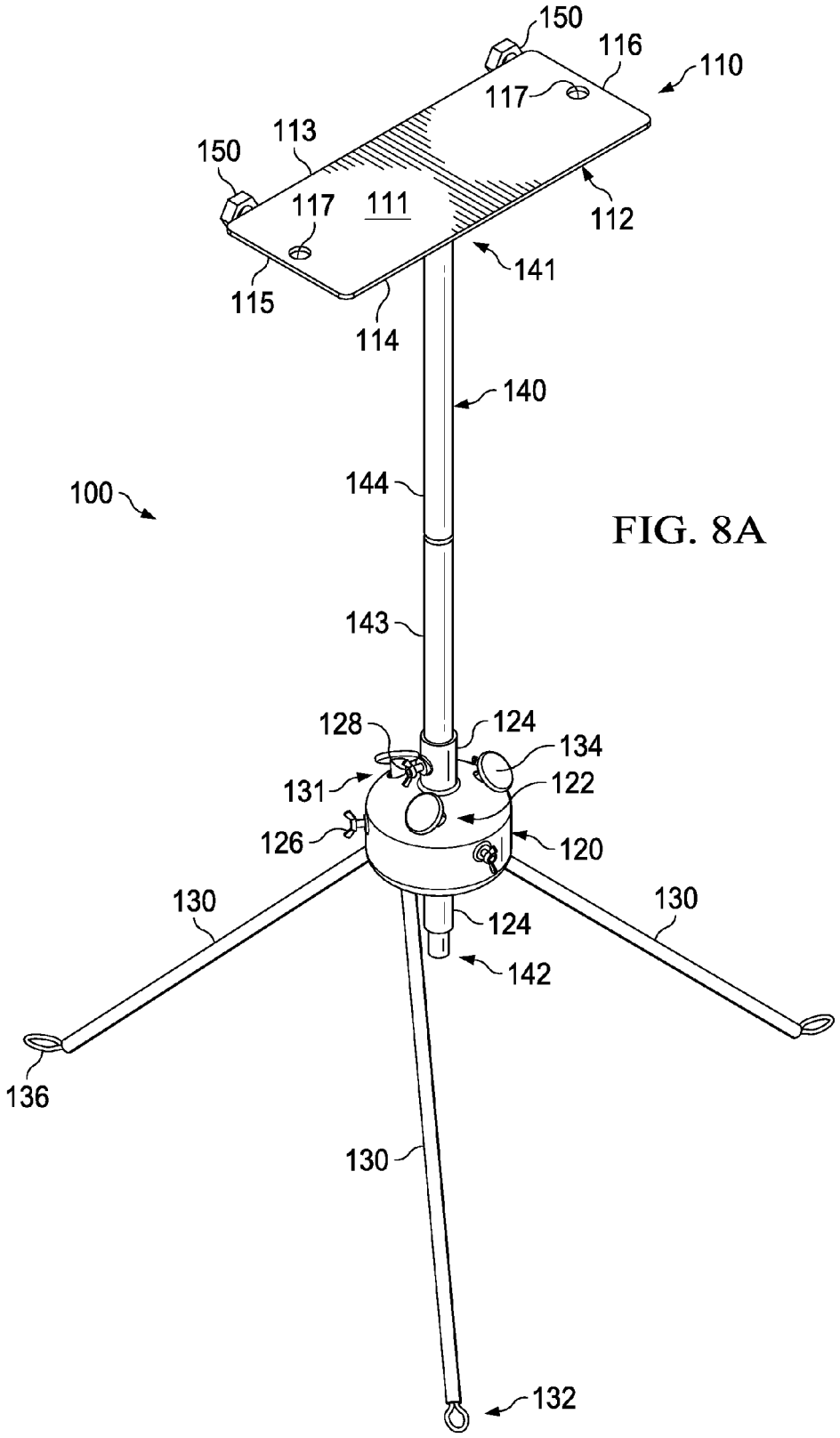
FIG. 8A illustrates a front perspective view of an implementation of an example stand.
Figure 8B:
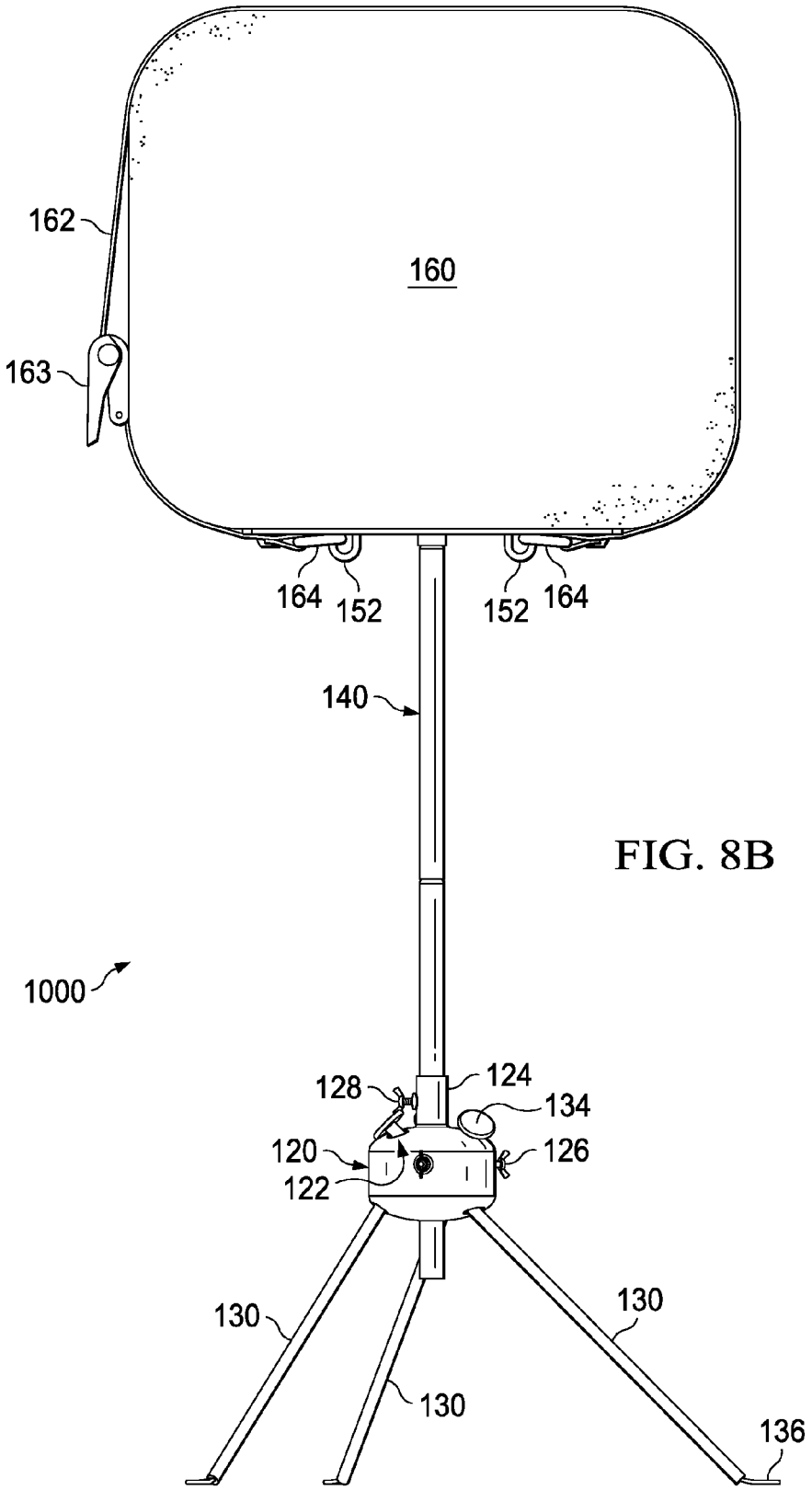
FIG. 8B illustrates a front view of an implementation of the example target that includes the stand illustrated in FIG. 8A.
Figure 8C:
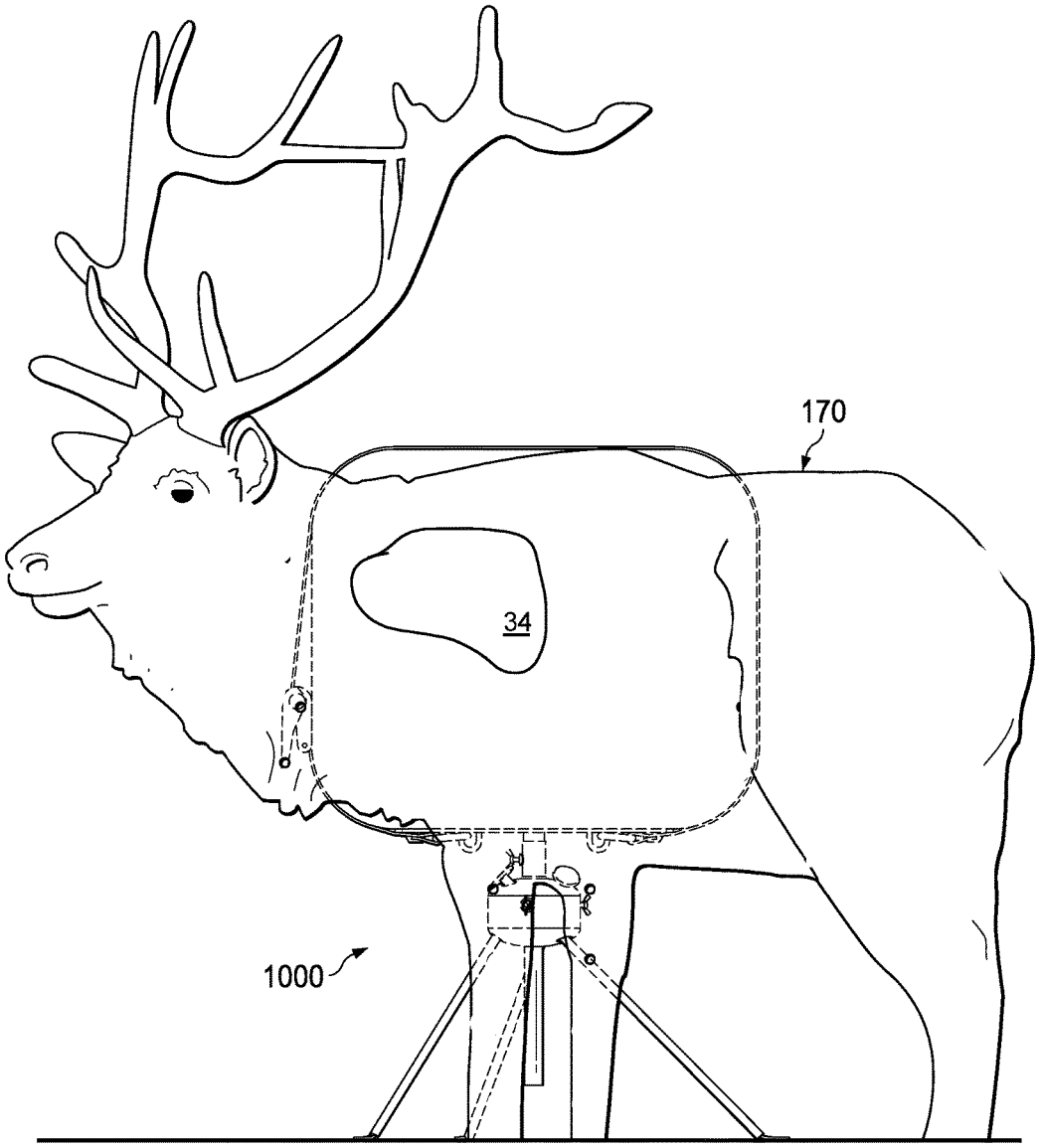
FIG. 8C illustrates a front view of an implementation of an example target that includes the stand illustrated in FIG. 8A.
Figure 8D:
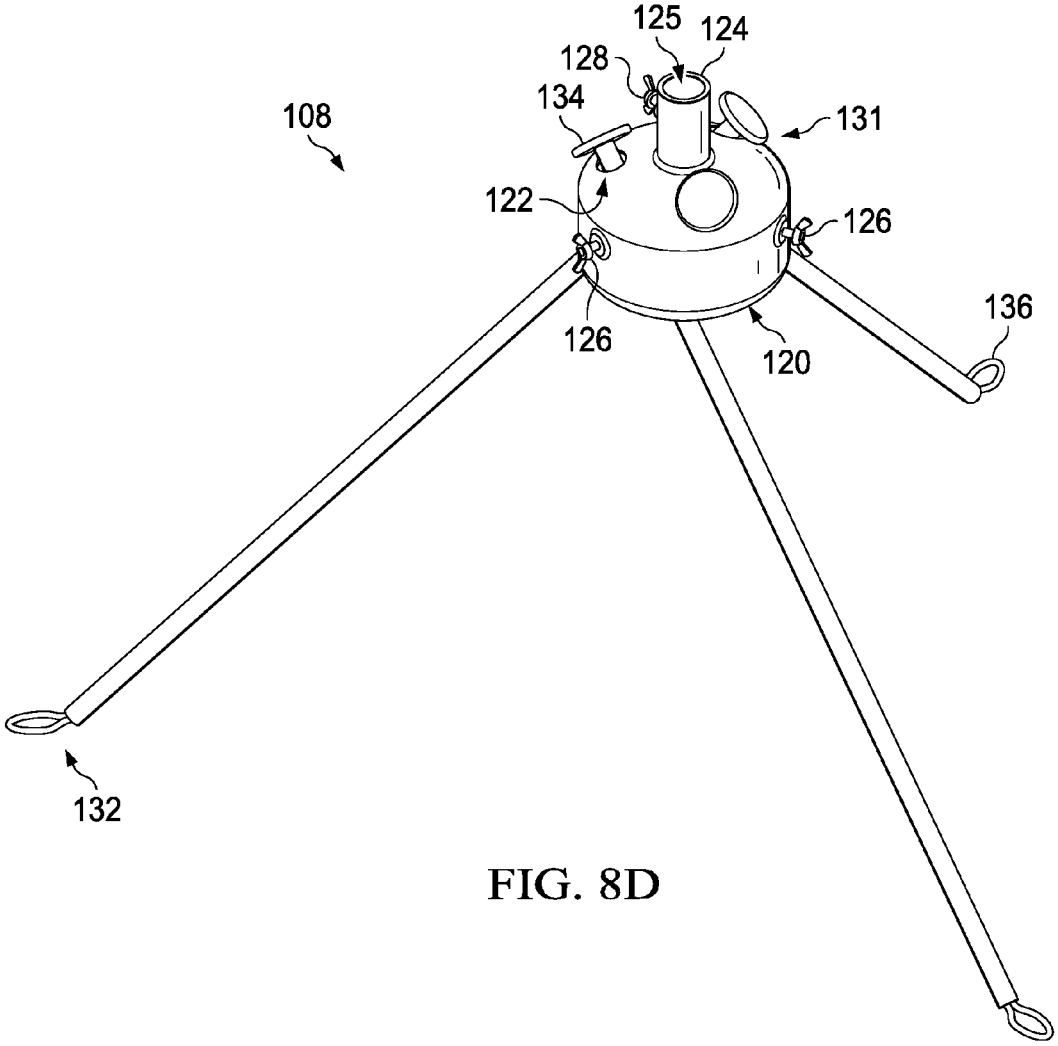
FIG. 8D illustrates a top perspective view of an implementation of a lower portion of the example stand illustrated in FIG. 8A.
Figure 9:
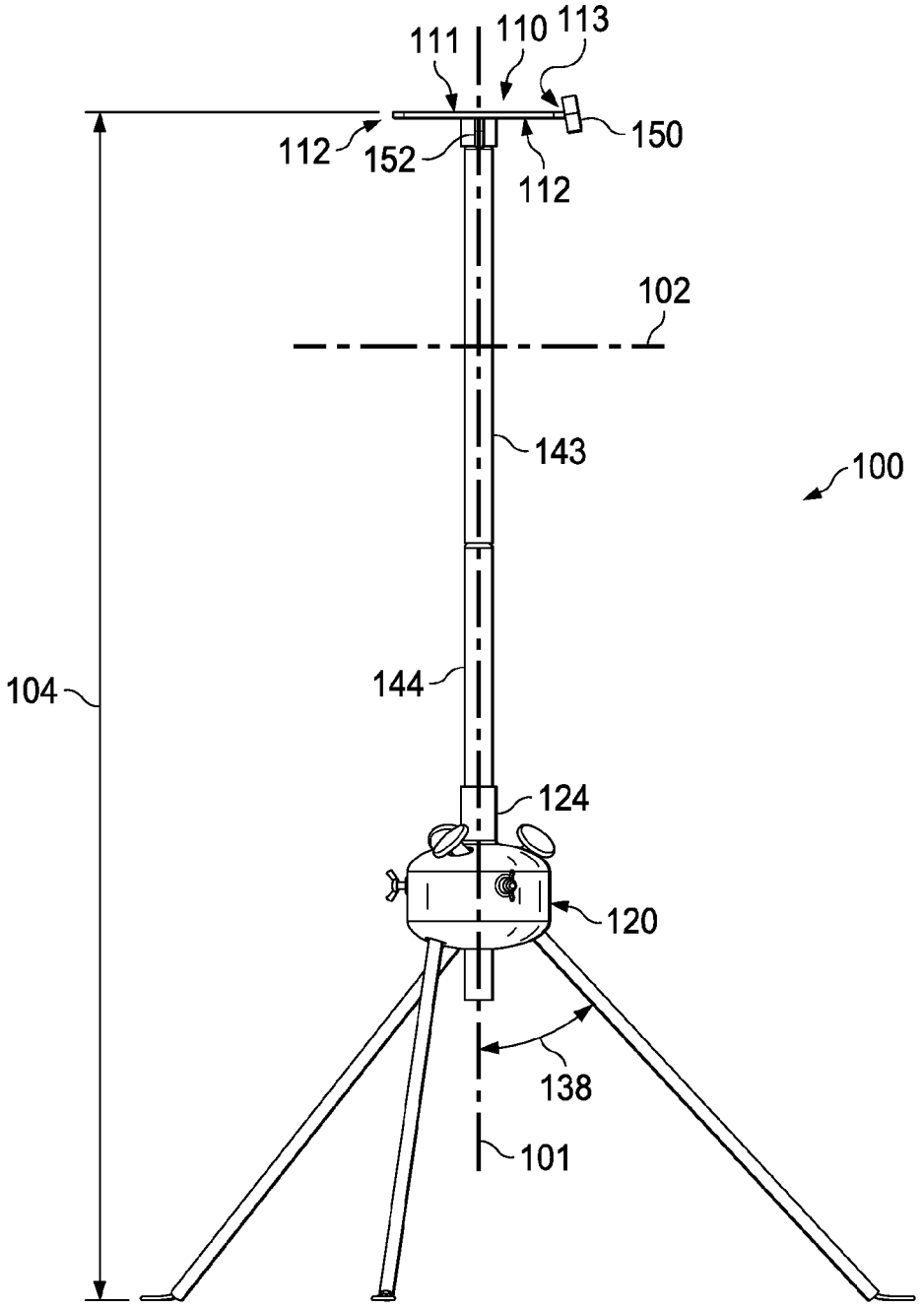
FIG. 9 illustrates a first side view of an implementation of the example stand illustrated in FIG. 8A.
Figure 10:
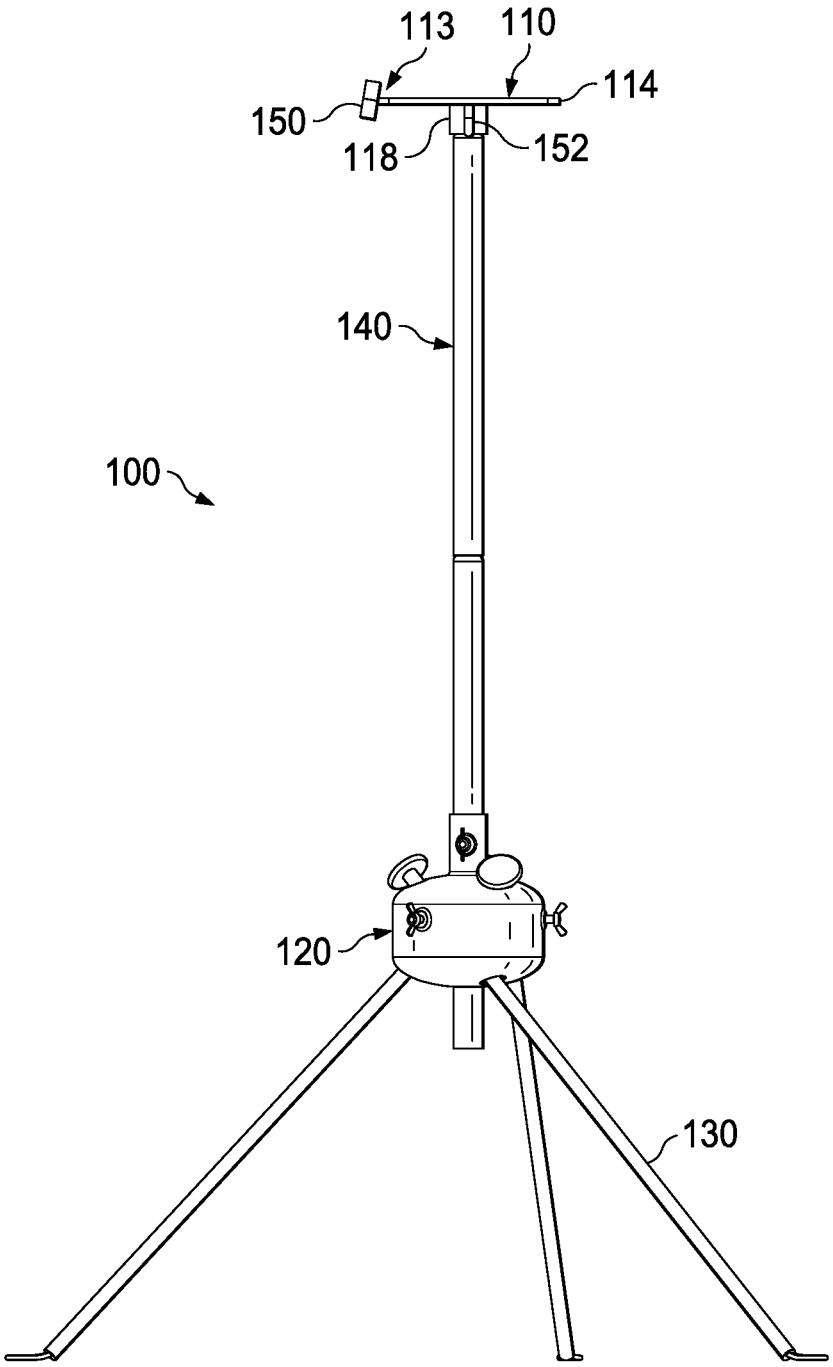
FIG. 10 illustrates a second side view of an implementation of the example stand illustrated in FIG. 8A.
Figure 11:
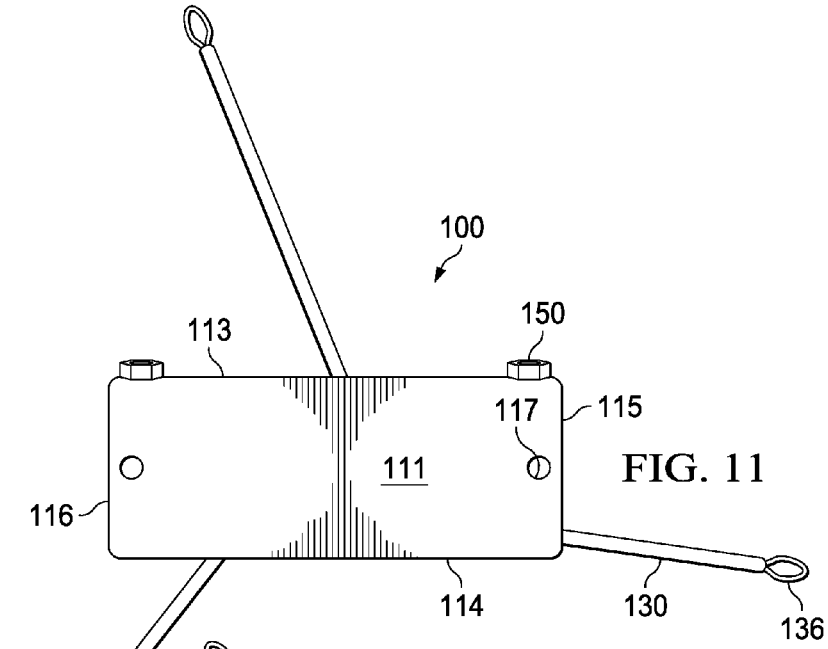
FIG. 11 illustrates a top view of an implementation of the example stand illustrated in FIG. 8A.
Figure 12:
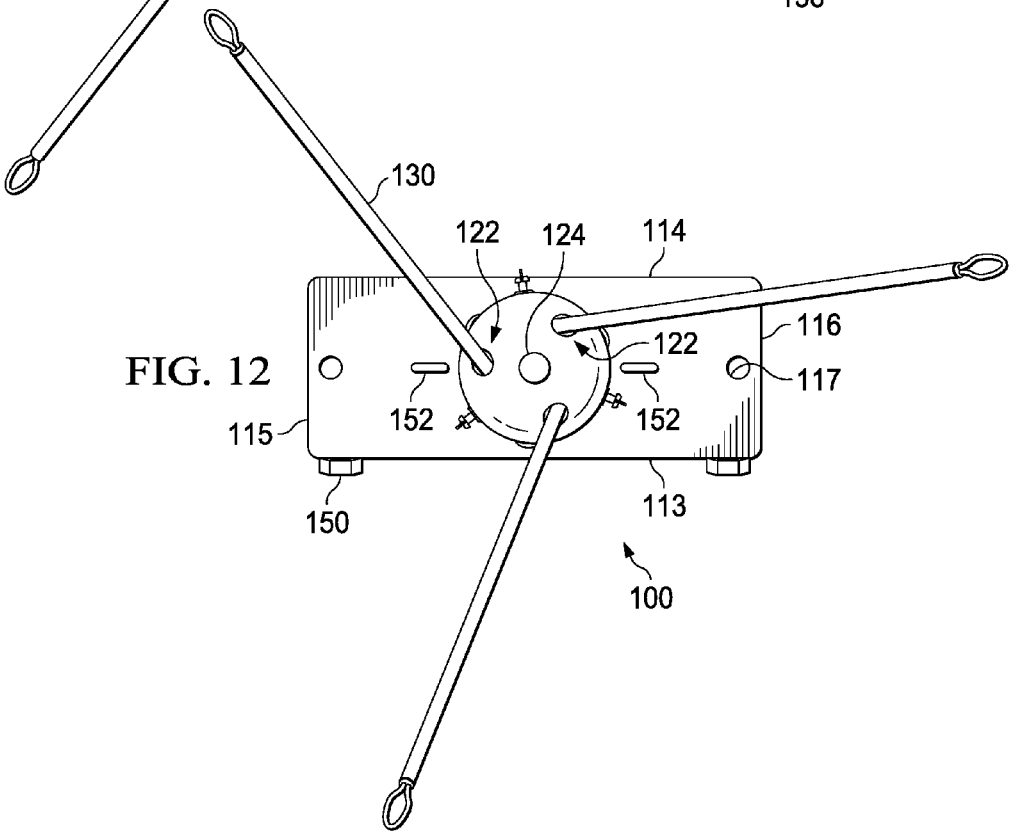
FIG. 12 illustrates a bottom view of an implementation of the example stand illustrated in FIG. 8A.
Figure 13:
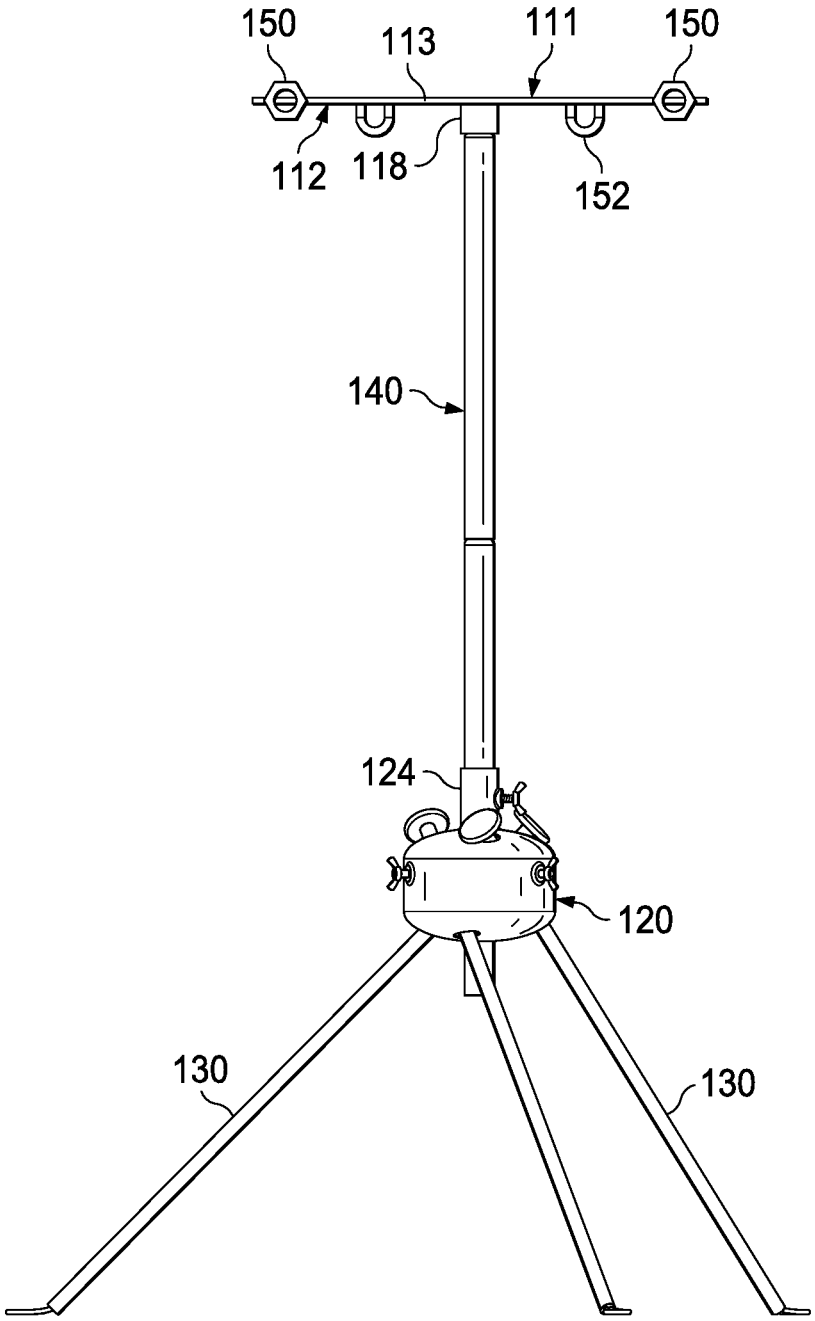
FIG. 13 illustrates a back view of an implementation of the example stand illustrated in FIG. 8A.

FIGS. 8A-13 illustrate different views of an implementation of a stand. FIG. 8A illustrates a front perspective view of an implementation of an example stand. FIG. 8B illustrates a front view of an implementation of the example target that includes the stand illustrated in FIG. 8A. FIG. 8C illustrates a front view of an implementation of an example target that includes the stand illustrated in FIG. 8A. FIG. 8D illustrates a top perspective view of an implementation of a lower portion of the example stand illustrated in FIG. 8A. FIG. 9 illustrates a first side view of an implementation of the example stand illustrated in FIG. 8A. FIG. 10 illustrates a second side view of an implementation of the example stand illustrated in FIG. 8A. FIG. 11 illustrates a top view of an implementation of the example stand illustrated in FIG. 8A. FIG. 12 illustrates a bottom view of an implementation of the example stand illustrated in FIG. 8A. FIG. 13 illustrates a back view of an implementation of the example stand illustrated in FIG. 8A.

The stand may include any appropriate material. For example, the stand or portions thereof may include such as metals and/or metal alloys including but not limited to steel, aluminum, titanium, and/or any other appropriate metal. The stand may include plastics and/or reinforced plastics, in some implementations.

The stand 100 may be vertically aligned about an axis 101. An axis 102 may lie perpendicular to the axis 101. In some implementations, the axis 102 may be parallel with the support 110 and/or a ground on which the stand is disposed. The stand may have a height 104, a width, and a length. In some implementations the width may be the footprint of the stand. The stand may be disposed vertically and the axis 101 may be parallel to the height of the stand, in some implementations.

As illustrated, the stand 100 may include a support 110, a base 120, legs 130, and a post 140. The support 110 may be a component of the stand on which a target body may be disposed and/or coupled. The support may include a first surface 111 and an opposing second surface 112. The support may include sides disposed between the first surface and the second surface. The number of sides disposed between the first surface 111 and the second surface 112 of the support may be based on the cross-sectional shape of the support. As illustrated, the support 110 may have an approximately rectangular shape. The support 110 may include a first side 113, an opposing second side 114, a third side 115 that is disposed between the first side and the second side, and a fourth side 116 that is disposed between the first side and the second side. The support 110 may include one or more openings 117 disposed at least partially through the support. As illustrated, the openings may be disposed through the support (e.g., through the first surface and second surface of the support).

A target body may be disposed on a first surface of the support. The target body may include any appropriate target body, such as the target 10 and/or other commercially available target bodies such as Matrix Target (commercially available from Matrix Targets, LLC., http://www.matrixtargets.com). A target body may be coupled proximate the first surface (e.g., when compared to the proximity of the of second surface) of the support, in some implementations. The first surface may be smooth, approximately smooth and/or textured. The first surface 111 of the support 110 may include at least a portion to inhibit movement of the target body, in some implementations. For example, the first surface 111 or a portion thereof may include protrusions, recesses, a tacky layer, and/or combinations thereof. In some implementations, portions of the first surface (e.g., protrusions) may at least partially penetrate the target body.

The second surface 112 of the support 110 may be disposed opposite the first surface 111 of the support 110. The second surface 112 of the support 110 may be disposed closer to the ground than the first surface 111 of the support. The second surface 112 may be coupled to a post, in some implementations.

A post coupling member 118 may be disposed on the second surface 112 of the support 110. The post coupling member 118 may be any appropriate coupling member, such as a male connector (e.g., bolt), a female connector (e.g., a nut), a recess, and/or other appropriate connector. The post coupling member 118 may include a threaded portion to couple with at least a portion of the post (e.g., via at least a portion of the threads proximate an end of the post).

The support 110 may include one or more couplers 150 disposed on a first side 113. The coupler 150 may include any appropriate coupling member such as a female connector (e.g., nut, as illustrated in FIG. 8A), a male connector (e.g., a bolt), a recess, a protrusion, threads, etc. As illustrated, the couplers 150 include nuts (e.g., hex nuts) coupled to the first side 113 of the support 110. In some implementations, the couplers 150 may include a first coupler and a second coupler. The first coupler may be disposed closer to the third side than the second coupler and/or the second coupler may be disposed closer to the fourth side than the first coupler. In some implementations, a coupler may be capable of coupling with a leg and/or a post.

The support 110 may include protrusions 152 on the second surface 112. The protrusions 152 may extend from the second surface 1112 and include an aperture 153. For example, as illustrated, the protrusion 152 may include a loop. The aperture may couple the support 110 to a strap coupling a target body to the support surface. For example, as illustrated in FIG. 8B, a target body 160 (e.g., archery target body and/or ammunition target body), may be disposed on a first surface 111 of the support 110. A strap 162 may be disposed around at least a portion of the target body 160. The strap may include an adjuster 163 which allow the length of the strap to be adjusted. Adjusting the length of the strap 162 may allow different sized target bodies to be coupled to the support using the same strap (e.g., since the strap length can be adjusted to secure a target body to the support). The strap 162 may include strap couplers 164. The strap couplers may include any appropriate connector, such as a hook, a clip, etc. In some implementations, a strap coupler may be disposed proximate each end of the strap 162. The strap coupler may couple with the protrusion 152 disposed on the second surface 112 of the support.

In some implementations, the support may be coupled to a post 140. The post may be any appropriate shape and/or size. For example, the post may be a cylindrical conduit. The post 140 may include a first end 141 and a second end 142. The first end may include a first post coupler. The first post coupler may include any appropriate coupler. The first post coupler may couple with the post coupling member 118 of the support 110. For example, threads may be disposed proximate the first end 141 of the post 140. The first end 141 of the post 140 may be disposed at least partially in the post coupling member 118 of the support member and/or at least a portion of the threads of the post may couple with threads of the post coupling member. In some implementations, the first end of the post may be disposed in the post coupling member of the support and a fastener (e.g., pin, clip, screw, etc.) may retain the first end of the post in the post coupling member.

The post 140 may include a second end 142. The second end of the post 140 may be disposed proximate the base 120 and/or couple with the base or portions thereof.

In some implementations, the post may include one or more sections. As illustrated, a post may include a first post 143 and a second post 144. A first end of the first post 143 may be coupled to a second end of a second post. By utilizing a sectioned post, the height (e.g., of the stand and/or of the support relative to the base) may be adjusted. Each post section may include a first sectional coupler proximate a first end of the post section and/or a second sectional coupler proximate a second opposing end of the post section. The first sectional coupler of a post may be capable of coupling with a second sectional coupler of another post. For example, a first sectional coupler may include threads disposed on an outer surface proximate a first end of a post section. A second sectional coupler may include threads disposed on an inner surface (e.g., of a recess of the post) proximate the second end of a post. The first end of a first post may be disposed in a recess (e.g., the post section may be hollow or at least partially hollow) of a second post such that the threads of the first sectional coupler of the first post may coupled with at least a portion of the threads of the second post. In some implementations, other types of couplers may be utilized to couple a first post and one or more other posts. For example, an end of a post may be disposed in an end of another post an a fastener may couple the posts. The fastener may pass at least partially through the posts to couple the posts together and/or a fastener may pass through a first post and contact a second post to couple the posts together.

In some implementations, two or more post sections may be coupled together to configure a post. More post sections may be coupled together to configure a longer post and fewer posts may be coupled together to form a shorter post. Thus, a post may be configured to a height appropriate for a particular application. For example, a user may select a height appropriate for a selected overlay (e.g., a overlay for a small animal may be utilized with a shorter height stand than a deer or other large animal overlay).

The post 140 may be coupled to the base 120 proximate a second end 142 of the post. The base may be any appropriate shape and/or size. As illustrated, the base 120 may include two curved sections (e.g., upper curved section and lower curved section) joined by a third section (e.g., cylindrical section). The base may be hollow, partially hollow, and/or solid. In some implementations, the base may be hollow to decrease costs and/or weight. In some implementations, a solid base may be utilized to increase the weight of the stand (e.g., to increase stand stability).

The base 120 may include one or more leg openings 122 and a brace 124. The brace 124 may extend from an upper surface of the base and/or a lower surface of the brace. In some implementations, the brace may include a conduit that extends through the brace. The brace may include an opening at least partially through the brace that may receive at least a portion of the post. For example, a second end 142 of the post 140 may be disposed at least partially through the brace 124 to couple the post and the base 120. In some implementations, a height of the post may be adjusted by adjusting the position of the second end of the post relative to the brace. For example, the post may be moved up or down (e.g., relative to the brace) to configure the stand to have a predetermined height. The brace may include one or more post fastener openings. A post fastener opening may extend from an outer surface of the brace to the opening in which the post is disposed. A post fastener (e.g., any appropriate fastener such as a screw and wing nut, screw, pin, clip, etc.) may be disposed through the post fastener opening and contact the post to inhibit movement of the post from a predetermined position.

In some implementations, at least three leg openings 122 may be disposed about a base 120. As illustrated, the three leg openings 122 may be disposed about a perimeter of the base 120. The leg openings may extend from an upper curved section to a lower curved section of the base 120. The leg openings may be disposed at angle 138 relative to the first axis 101 (e.g., the axis disposed parallel to the post and/or height of the stand). For example, the leg openings may be disposed at an angle of approximately 10 degrees to approximately 80 degrees relative to the first axis 101. The angle of the leg openings may allow the legs 130 of the stand to be radially disposed about the base. The angle of the leg openings may inhibit movement of the legs from the weight of the frame and/or target body. For example, the angle of the leg openings may cause a resistive force to act upon the legs to inhibit movement of the leg(s) based on the weight of the frame and/or target body. Once a frame is disposed in an orientation (e.g., by the user applying a force greater than the resistive force to the frame or portions thereof), the angle of the leg openings may inhibit further movement (e.g., from the orientation in which the frame is disposed) based on the weight of the frame and/or the target body).

In some implementations, the base may include one or more leg fastener openings disposed from an outer surface of the base to a leg opening. A leg fastener (e.g., any appropriate fastener such as a clip, pin, screw and wing nut, screw, etc.) may be disposed in a leg fastener opening to inhibit movement of a leg disposed in the leg opening. For example, a leg 130 may be disposed in the leg opening in a predetermined position and to inhibit movement from the predetermined position, a leg fastener may contact the leg through the leg fastener opening to inhibit movement.

A leg 130 of the stand 100 may be any appropriate size and/or shape. The leg may include a first end 131 and a second opposing send 132. A head 134 may be disposed proximate a first end 131 of the leg. The head 134 of the leg may at least partially retain the leg in a leg opening 122 of a base 120. For example, a leg 130 may be inhibited from slipping through the leg hole based on the size and/or shape of the head 134 of the leg. In some implementations, the second end of the leg may include an anchoring member 136. The anchoring member 136 may include any appropriate component(s) to at least partially secure a leg, and thus the stand, to a location. As illustrated, the anchoring member 136 may include a loop. The loop may be flexible and/or rigid. A ground anchor (e.g., sand and/or earth anchor) may contact and/or couple with the loop to at least partially secure the leg and/or stand to the location in which the anchor is coupled. The anchoring member may include a tapered portion of the leg, which is insertable into a ground. In some implementations, the leg may not include an anchoring member and may rest on a ground. For example, the leg may include nonslip end caps.

In various implementations, the stand 100 may be self-leveling. By utilizing legs radially disposed about the stand that are height adjustable, each leg's position may adjust (e.g., relative to the base) in the leg opening of the base when a base is disposed on a surface (e.g., ground at a location). For example, when a base is disposed on a ground, the position of each leg in a leg opening may adjust relative to the base. In some implementations, the leg fasteners may couple with the legs (e.g., contact and/or disposed at least partially through the leg) to maintain the leg positions. Thus, weight the target body is disposed on the stand and/or when shots (e.g., arrow and/or ammunition) are taken on the target body the leg position may be maintained. In some implementations, a support and/or stand may be maintained in an orientation (e.g., approximately level) even when variations exist in a ground. For example, since each leg position is adjustable in the leg opening of the base, an orientation of the support and/or stand may be selected by a user by adjusting the leg position of one or more legs (e.g. when the ground is level and/or not level).

In some implementations, the legs may adjust relative to each other to allow a user to set the stand at a predetermined height and/or orientation. For example, a user may position the support and/or stand at a first height and/or orientation. The user may adjust the first height and/or orientation to achieve the predetermined height and/or orientation. Since the legs are free to move within the leg openings of the base (e.g., when fasteners are not coupled to the leg), as the user selects and/or adjusts a height and/or orientation (e.g., angle at which the support is disposed), the legs may automatically adjust. When the predetermined height and/or orientation is achieved, fasteners 126 may be coupled to the leg to inhibit movement of the legs.

In some implementations, the height of the stand may be adjusted by adjusting the position of the leg(s) relative to the base. For example, a user may exert a force on the stand (e.g., on the support, post, and/or base downwards towards the legs) to decrease a height of the stand since the force may cause the leg positions to adjust in the leg openings of the base. A user may exert an upwards force on the stand (e.g., lift the support, post, and/or base) to increase a height of the stand since the leg positions may adjust when the upwards force is applied. The position selected by a user may then be maintained (e.g., movement from the selected position may be inhibited) using the leg fasteners. In some implementations, a height of a stand may be adjusted by adjusting the height of the post (e.g., via relative position in the brace), adjusting the number of post sections utilized, and/or by adjusting a height of the legs (e.g., via a relative position of one or more legs in the leg openings of the base), a variety of heights may be selected using the same stand.

The stand may be used such that both sides of a target body may be accessed. For example, some targets, such as target 10, include aiming zones on each of two opposing sides. The stand may allow the support to be rotated to allow a shooter on a first side of the stand to shoot at either side (e.g., the user may shoot at a first side and then rotate the support and/or stand to shoot at a second side of the target). The stand may allow a shooter to be disposed on either side (e.g., first side, such as the side illustrated in FIG. 8C and/or second opposing side) of the stand and shoot at the target body.

In various implementations, the stand 100 may facilitate shooting by not including stand components in the aiming zone. As illustrated in FIGS. 8A and 8C, since the target body is disposed on the support and/or coupled to the support via a strap around a perimeter of the target body, components of the stand are not disposed proximate aiming zones of the target body (e.g., behind the aiming zone). Thus, arrows that inadvertently pass through the target body are not substantially damaged by the stand.

The stand 100 may be utilized in combination with a variety of target bodies, such as target body 14 and/or any other appropriate target body for arrows or ammunition. FIG. 8B illustrates an implementation of an archery target 1000 that includes the stand illustrated in FIG. 8A and a target body 160. The target body may include aiming zone(s) 34, 38 and/or other target aiming zones (e.g., bulls eyes, etc.). FIG. 8C illustrates an implementation of an example archery target 1001. As illustrated, the archery target 1001 includes the stand illustrated in FIG. 8A and an overlay 170. Any appropriate overlay and/or any appropriate target body may be utilized with the stand. The overlay 170 may include an aiming zone. The aiming zone may be an aperture in the overlay and/or a region (e.g., marked or unmarked) on the overlay. In some implementations, a target body 160 may include at least one aiming zone that protrudes from the target body and the overlay may include an aiming zone aperture. The height of the stand may be adjusted, as described, such that the protruding aiming zone on the target body may at least partially align with the aiming zone aperture on the overlay. By allowing the height of the stand to be adjusted, a variety of overlays (e.g., corresponding to different animals, targets, etc.) may be utilized with the same stand. In some implementations, the target body may be similar to target body 14 with aiming zones disposed on opposing sides of the target body and/or with off-center aiming zones. Thus, since the height of the stand can be adjusted and the aiming zone of the target body can be adjusted (e.g., by adjusting the orientation of the target body), the stand, the target and/or overlay may be utilized in combination to create a plurality of different configurations.

The height of the stand may be adjustable via the position of the legs in the leg openings and/or height of the posts (e.g., relative to the brace of the base and/or from use or lack of use of specific post sections). In some implementations, a user may shoot at a lower height that the stand allows. For example, the user may target practice on small animals for which the target body is positioned on the floor. The stand 100 may be utilized in a second orientation that allows a lower height (e.g., lower height than achievable with the stand when the base is coupled to the legs of the stand).

Figure 14A:
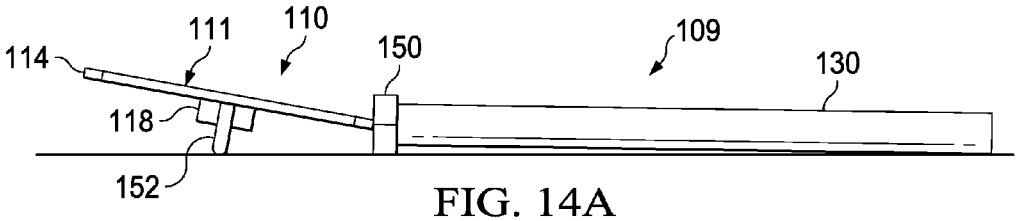
FIG. 14A illustrates an implementation of an example target stand.
Figure 14B:
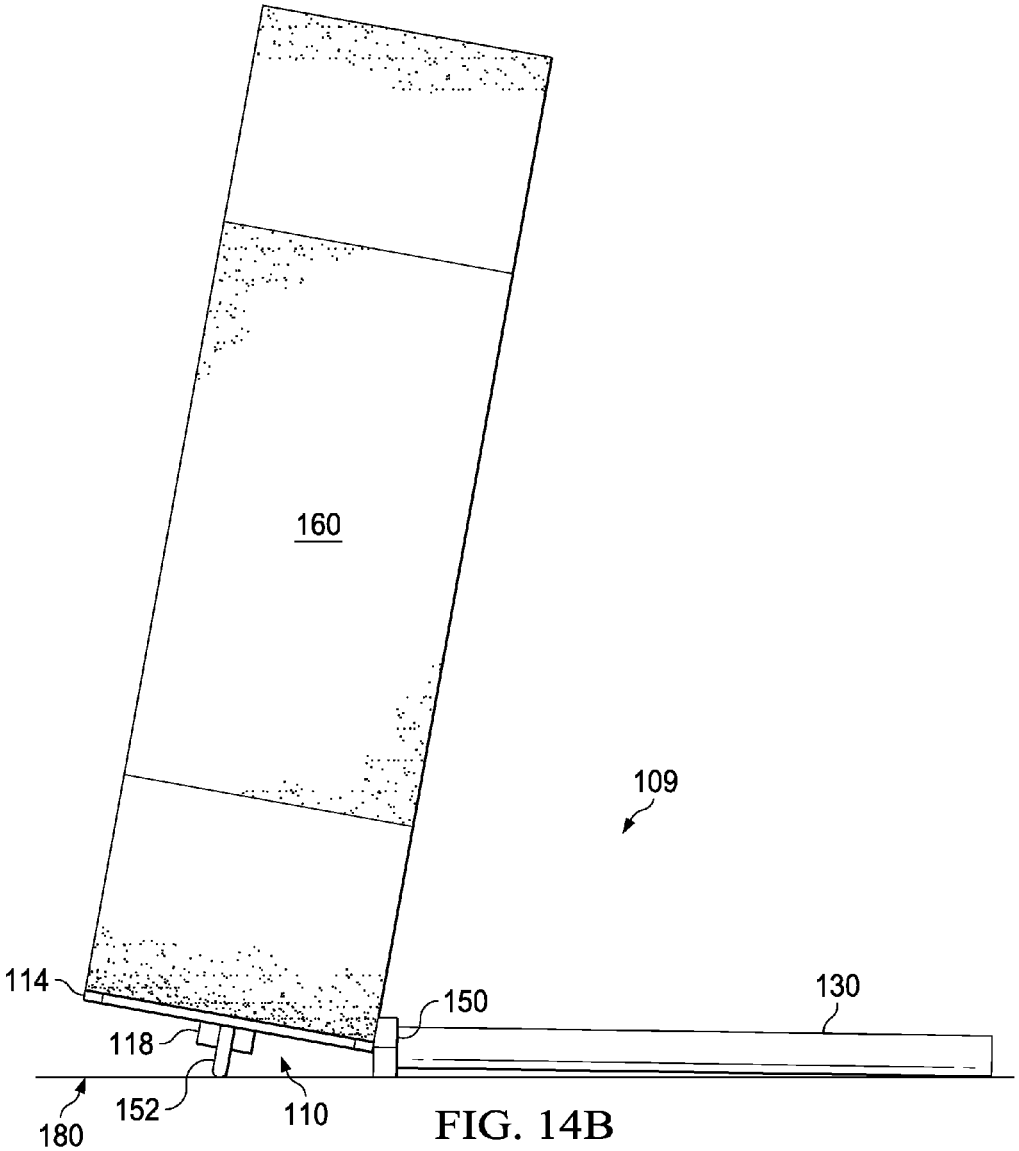
FIG. 14B illustrates an implementation of an example target.

In some implementations, the stand may include a support utilized with (e.g., a first orientation of the stand) or without the base (e.g., a second orientation of the stand). By utilizing the stand without the base coupled to the legs, a smaller profile and/or shorter height stand may be configured (e.g., when compared to the use of the stand with a base and coupled legs). The smaller stature stand may allow a target body to be positioned lower to the ground. A smaller stature stand may increase user satisfaction since the same stand (e.g., with reconfiguration) may be utilized with large and/or small animal overlays. The stand, illustrated in the first orientation in FIGS. 8A-13, may be adjusted to a second orientation that does not utilized the base 120. FIGS. 14A and 14B illustrate an implementation of the stand 100 illustrated in FIG. 8A configured as a target without using the base. FIG. 14A illustrates a side view of an implementation of an example target stand and FIG. 14B illustrates side view of an implementation of an example target. As illustrated, stand 109 includes a support 110 disposed on a surface 180, such as the ground. A target body 160 may be disposed on the support 110. In some implementations, an overlay may be utilized with the stand 109 and/or the target body. For example, the overlay may be coupled and/or disposed on the support. In some implementations, the overlay may be coupled to the target body (e.g., strapped onto, affixed, retained by friction, etc.).

Figure 14C:
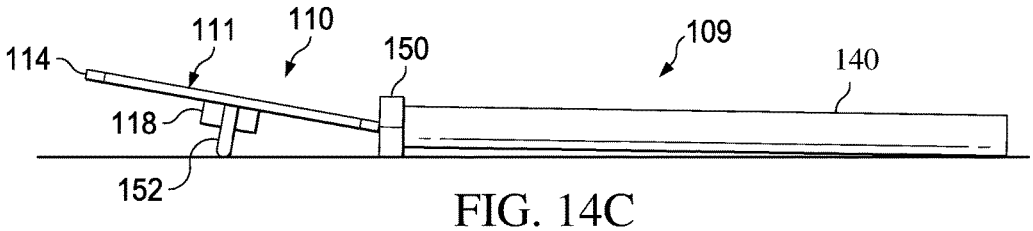
FIG. 14C illustrates an implementation of an example target stand.

The support 110 may be similar to the support illustrated in FIG. 8A. The support 110 includes a first surface 111 and a second opposing surface 112. The second side 113 of the support 110 may include one or more protrusions 152. As illustrated, the protrusion may contact a surface 180 and support the stand and/or target bodies disposed on the stand. The protrusion(s) 152 may be utilized as a leg of the stand when the stand is utilized without the legs 130 and/or post. The first side of the support includes one or more couplers 150. The couplers may be similar to the post coupler to allow the posts (e.g. ends of the post) to couple with the post coupler and/or the couplers of the support based on which configuration a user would like to assemble (e.g., with base and/or without base) (see e.g., FIG. 14C). The support may include a first coupler disposed proximate a third side of the support and a second coupler disposed proximate a fourth side of the support. In some implementations, a first coupler may be disposed approximately half the distance between the third end and the post coupler and/or the second coupler may be disposed on the first side at approximately half the distance between the fourth end and the post coupler. A post section may be coupled to a coupler of the support. A first post section may be coupled to a first coupler of the support and a second post section may be coupled to the second coupler of the support. At least two couplers and/or post sections may be utilized in a coupled configuration to support the weight of the stand and/or target body and/or to inhibit movement of the stand during shooting (e.g., of arrows and/or ammunition). By disposing couplers proximate the third end and the fourth end of the support, movement of the stand when struck proximate the third and/or fourth ends may be inhibited (e.g., when an arrow strikes off center, the force of the strike may attempt to move the target body and thus the stand and the position of the couplers may allow resistance of this movement).

In some implementations, the support may be disposed at an angle relative to the ground in the second orientation. The couplers 150 of the support may be disposed such that when the couplers contact a ground and/or legs coupled to the couplers at least partially contact the ground, the support resting on the protrusions 152 is disposed at an angle. For example, the couplers may be disposed at a slanted angle relative to the first surface of the support. The couplers may be disposed on the support such that the height that the couplers extend past the second surface of the support is not approximately similar to the height that the protrusion 152 extends from the second surface.

Although the smaller statured stand has been described as coupling the post to the couplers of the support, in some implementations, ends (e.g., first ends or second ends) of the legs may be coupled to the couplers of the supports. For example a first end (e.g., when a leg does not include a head or on a portion of a head) and/or a second end of the leg may include a threaded portion that is capable of coupling with the couplers of the support.

The adjustable stand as described in FIGS. 1A-5 and 7-14B and/or other stands may be utilized with a variety of target bodies. The target body selected by a user may be based on the desired use of the target, type of target practice (e.g., archery and/or ammunition), skill of user, and/or overlay to be utilized, if any. For example, the target body 14 may be utilized to provide a target body for archery with aiming zones. In some implementations, other target bodies and/or overlays (e.g., with or without target body) may be utilized with the described stands.

In some implementations, the support 110 may allow coupling of a variety of different types of target blocks. For example, as described, the protrusions 152 may be utilized with straps to couple a target body and/or overlay (e.g., disposed on a first surface of the support) to the support. In some implementations, brackets may be utilized to couple the target body and/or overlay to the support.

Figure 15:
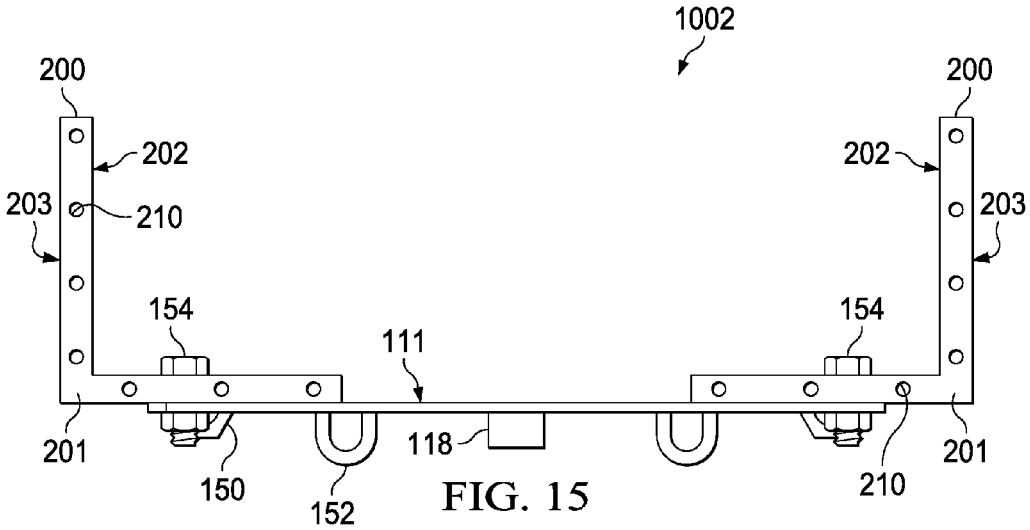
FIG. 15 illustrates a front view of an implementation of an example upper portion of a stand.

FIG. 15 illustrates an implementation of an upper portion 1002 of an example stand. The stand may be similar to or different from stand 100. The upper portion of the stand may be utilized with a base as illustrated in FIG. 8A and/or without a base as illustrated in FIG. 14A. As illustrated, the upper portion 1002 of the stand may include a support 110. The support may include a first surface 111 and a second surface 112. The support may include couplers 120 and protrusions 152. The support may include one or more openings 117 at least partially through the support. The openings may allow brackets 200 to be coupled to the support. In some implementations, at least one opening 117 may be disposed proximate a third end and at least one opening 117 may be disposed proximate a fourth end of the support. In some implementations, a plurality of openings may be disposed about a length of the support to allow the bracket to be coupled to the support at more than one position relative to the support.

A bracket may be utilized to couple one or more target bodies and/or overlay(s) to the support and thus the stand. The use of bracket(s) may extend the length and/or height of the support (e.g., to allow larger target bodies to be coupled to the support and/or to dispose the target body above the first surface of the support). Brackets may be utilized to couple different types of target bodies to the support (e.g., target bodies that do not rest on the first surface of the support). The brackets may be utilized to facilitate coupling, in some implementations.

The bracket 200 may be any appropriate size and/or shape. For example, the bracket may extend vertically, horizontally, and/or at an angle. The bracket 200 may include one or more arms to couple a target body and/or overlay to the support. As illustrated, the bracket may be L-shaped with at least one arm extending away from a base portion of the bracket 200. The bracket 200 may include one or more coupling apertures 210 extending at least partially through the bracket on one or more of the sides of the bracket. For example, a coupling aperture may extend from a second side 202 to a third side 203 of the bracket. In some implementations, the bracket 200 may include a plurality of coupling apertures 210 extending along the bracket 200. As illustrated, the bracket may include a first side 201 and a second side 202 adjacent to the first side. The bracket may include coupling apertures on the first side and/or second side. In some implementations, the coupling apertures may be disposed on all sides (e.g., a four sided bracket may include one or more coupling apertures disposed on each of the four sides, a pipe bracket may include apertures about a perimeter of the pipe, a five sided bracket may include one or more apertures disposed on each of the five sides, etc.). For example, that bracket may be formed from perforated conduits, such as commercially available perforated conduits from S-Square Tube products (S-Square, Broomfield, Colo., USA) and/or Unistrut (Unistruct Co., Cleveland, Ohio, USA).

The coupling apertures may be utilized to couple the target body, overlay(s), sensors, straps, and/or to couple the bracket to the support. For example, a fastener 154 may be disposed through an aperture on the second side 202 of the bracket 200 and at least partially through opening 117 in the support to couple the bracket and the support.

In some implementations, the bracket 200 may include one or more loops. A loop may extend from an adjacent side 202 of the bracket to allow various components of the target to be coupled to the bracket, such as but not limited to target bodies, sensors, straps, and/or overlays. A loop may have any appropriate size and/or shape. For example, a loop may be u-shaped. A loop may not contact the adjacent side 202 of the bracket at both ends of the loop (e.g., a first arm of the loop may contact the adjacent side 202 of the bracket and a gap may exist between a second arm of the loop and the adjacent side 202), in some implementations. A loop may include an aperture which may be utilized to facilitate coupling with components of the target (e.g., straps, overlays, connectors, etc.).

The bracket 200 may include more than one loop disposed along a length of at least a portion of the bracket. For example, more than one loop may be disposed along an arm that extends from a base of the bracket, as illustrated in FIG. 16A.

In various implementations, one or more brackets may be coupled to the support. A single bracket may extend from more than sides of the support (e.g., to increase a length, width and/or height of a support). A bracket may be disposed on each of two opposing sides, in some implementations. As illustrated, a first bracket may be coupled proximate a third end 113 of the support 100 and a second bracket may be coupled proximate a fourth 114 end of the support via fasteners 154. The use of two brackets, each disposed on opposing sides of the support, may create an approximately U-shaped support to which target bodies and/or overlays may be coupled.

Figure 16A:
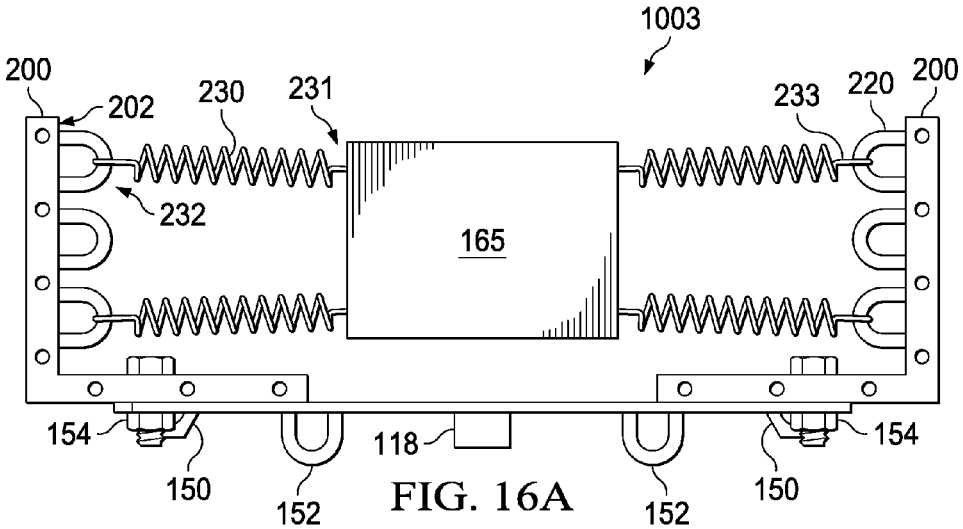
FIG. 16A illustrates a front view of an implementation of an example upper portion of a target.

FIG. 16A illustrates an implementation of an upper portion of an example target 1003. Different target bodies may be utilized for archery than for ammunition. Target 1003 illustrates a target body 165 that may be utilized with ammunition. Target body 165 may include a plate, in some implementations. The plate may be made of any appropriate material to inhibit the ammunition that strikes the plate from passing through the plate. For example, the plate may be metal (e.g., titanium), composites (e.g., Kevlar, ballistic fiberglass, etc.), thermoplastic polymers (e.g., polycarbonate), etc. The plate may have a thickness to inhibit ammunition (e.g., bullet) from passing through the plate. The plate thickness may be selected based on the ammunition to be used, in some implementations.

In some implementations, the target body 165 may be similar to target body 1003 and may be utilized with arrows. The target body 165 may be capable of inhibiting arrow(s) and/or ammunition from passing through the target body. In some implementations, the target body may include different materials when designed to receive arrows than ammunition. For example, a metal plate may be utilized as the target body for ammunition such as bullets while a softer material such as a foam and/or hay may be utilized as a target body for arrows. Since arrows may be reused after striking the target body if the target body does not substantially damage the arrows while ammunition is generally single use, a softer target body may prolong repeat use of arrows.

The target body 165 may be coupled to the brackets 200, which are coupled to support 110, via flexible connectors 230. The flexible connector(s) 230 may be utilized to dispose the target body in a predetermined position relative to the bracket(s). For example, the target body may be disposed center, off-center, at an angle, approximately parallel to the first surface of the support, approximately perpendicular to the first surface of the support, at a first height from the first surface of the support, at a second height (e.g., greater than the first height) from the first surface of the support, and/or combinations thereof. The position of the target body may be based on user criteria (e.g., user height, type of practice being performed), overlay to be used, type of gun being used, etc.

A flexible connector may include any appropriate flexible connector, such as a spring. The flexible connector 220 may be flexible to allow absorption of at least a portion of the force with which ammunition strikes the target body 165. For example, when a bullet strikes the target body 165, the flexible connectors may move (e.g., expand in length) to absorb some of the force (e.g., to reduce the likelihood that the force with which the bullet strikes causes the bullet to pass through the target body). The flexible connector may include a first end 231 and a second opposing end 232. The first end 231 of the flexible connector may couple with the target body 165. For example, the first end may include a connector (e.g., hook) that is adapted to couple with a coupling member (e.g., loop) of the target body. The second end 232 of the flexible connector may be coupled to the bracket. For example, the second end of the connector may include a coupler (e.g., a hook) to couple with one or more coupling apertures 210 of the bracket 200. The first end may couple with loops 220 of the bracket 200.

In some implementations, more than one flexible connector may be utilized to couple the target body 165 to the support via the bracket(s). As illustrated in FIG. 16A, four flexible connectors may be utilized to couple the target body to the brackets. In some implementations, other configurations may be utilized. For example, a flexible connector may extend between the brackets and the target body may be coupled to the flexible connector (e.g., via a hook, loop, and/or other coupling member on the target body).

Figure 16B:
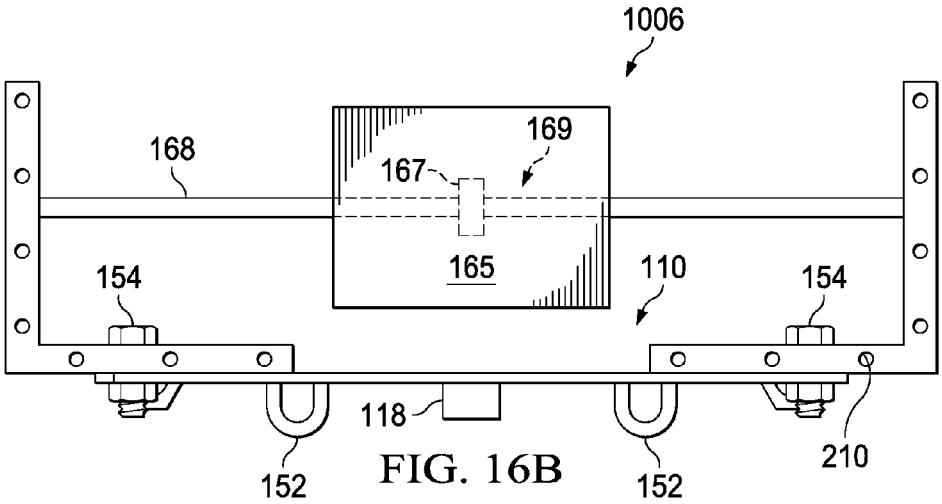
FIG. 16B illustrates a front view of an implementation of an example upper portion of a target.

Although the connector 220 has been described as flexible, in some implementations, the connector may be rigid. For example, rigid connectors may couple with the target body 165 at a first end and the bracket at a second end. FIG. 16B illustrates an implementation of an example upper portion 1006 of a target, in which a rigid connector utilized to couple the target body 165 to the support 110. As illustrated, a rigid connector 168 may be coupled at a first end with a first bracket and coupled at a second end with a second bracket. The target body 165 may include a first side to be stricken by ammunition, and a second opposing side 169. The second opposing side 169 of the target body 165 may include a coupling member 167. The coupling member 167 may be any appropriate size and/or shape and couple with the rigid connector 168. As illustrated, the coupling member may include a loop through which the rigid connector 168 is disposed.

In some implementations, the target body may be an approximately rigid body, such as a plate (e.g., for ammunition practice). The coupling member 167 of the target body may allow the target body to rotate about the rigid connector 168. Thus, when a bullet strikes the target body 165, the force at which it strikes the target body (e.g., plate) may cause the target body to rotate about the rigid connector. In some implementations, the target body may self-orient such that the first side of the target body returns to it's initial orientation after rotating about the rigid connector. For example, the target body may have a greater thickness proximate a bottom (e.g., side closest to the first side of the support) of a target body and/or a weight disposed proximate a bottom of the target body.

In some implementations, a first side of the target body may have a different color and/or pattern than the second side of the target body. Thus, when a bullet strikes the target body and causes the target body to rotate about the rigid connector, a user may be able to visually see a color and/or pattern change. In some implementations, an overlay coupled to the stand (e.g., via brackets) may inhibit viewing of the rotation of the target body and the change in color and/or pattern due to viewing different sides of the target body may facilitate identification of a shot within a predetermined area (e.g., on the target body).

Figure 16C:
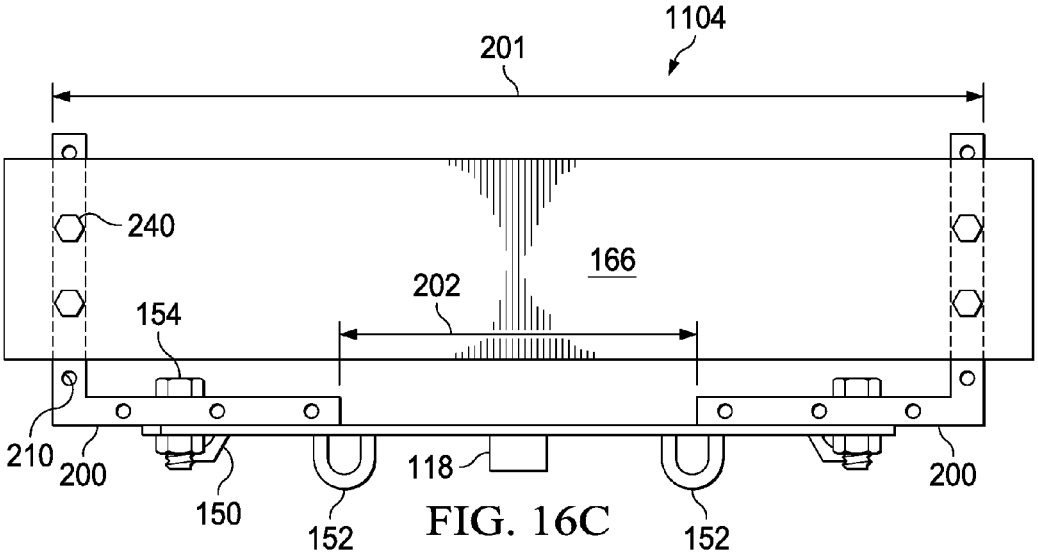
FIG. 16C illustrates a front view of an implementation of an example upper portion of a target.

In some implementations, the target body may extend between the brackets and directly couple with the brackets. FIG. 16C illustrates an implementation of an example upper portion of a target 1104. As illustrated, a target body 166 may be coupled proximate a first end 166*a* to a first bracket and coupled proximate a second end 166*b* to a second bracket. A target body 166 may be coupled to a bracket via coupling apertures 210 of the bracket 200. A fastener 240 (e.g., screw, bolt, and/or any other appropriate fastener) may extend through the target body 166 and at least partially into a coupling aperture of a bracket to couple the target body 166 to a bracket. The target body 166 may be a plate target body for ammunition, in some implementations.

Figure 16D:
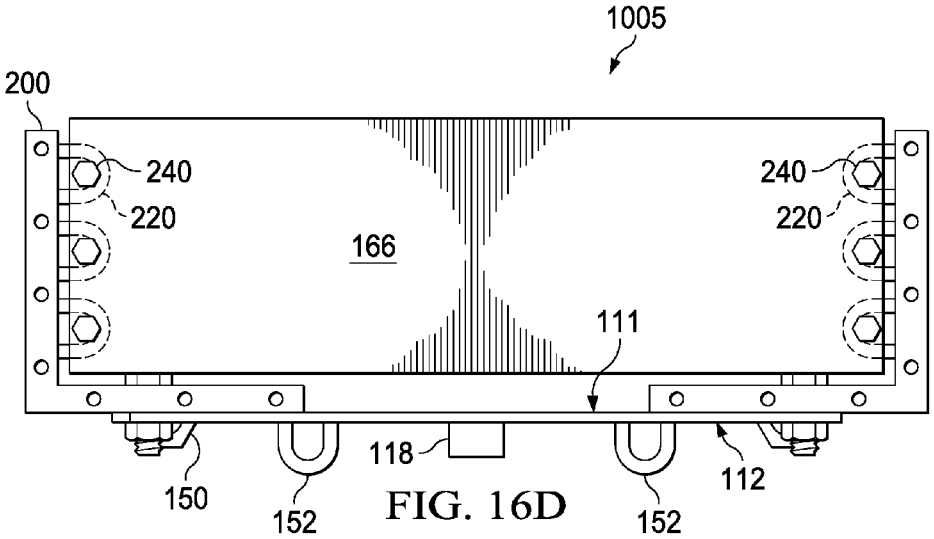
FIG. 16D illustrates a front view of an implementation of an example upper portion of a target.

In some implementations, the target body may couple to the brackets via loops on the brackets, as illustrated in FIG. 16D. Fasteners 240 may pass through the target body 166 to couple the target body with loops 220 disposed on the bracket.

Although the implementation illustrated in FIGS. 16A-16D illustrates a single target body, more than one target body may be coupled to the support. For example, a first target body may be disposed in a first position relative to the support and a second target body may be disposed in a second position relative to the support. The number of target bodies coupled to the support may be based on user specifications, type of target practice (e.g., game in which shots to predetermined areas correlated to target bodies are assigned scores), size of target body, type of target body, whether overlays may be utilized, etc.

Although the implementation illustrated in FIG. 16A-16D illustrates an ammunition target body 165, other types of target bodies may be coupled to the support with the flexible connectors and the brackets. For example, a target body that includes polyurethane foam for archery target practice may be coupled to brackets via connectors 230.

In some implementations, one or more sensors may be coupled to the support and/or bracket. The sensor(s) may identify shooting events such as whether a target body has been struck and/or whether ammunition has passed through a plane. The sensors may provide notification (e.g., visual and/or audio) when the sensor has identified shooting event(s). For example, when a target body is struck, a light and/or sound may be generated.

In some implementations, an overlay may be coupled to the target illustrated in FIG. 16A-16D. For example, an overlay may be coupled via coupling apertures 210. For example, a fastener may be disposed through a portion of the overlay and at least partially through the coupling aperture 210 and/or loops 220. The overlay may extend to the ground on which the stand is disposed and/or be disposed over a portion of the stand and/or target body. In some implementations, the overlay may be coupled to the stand in place of target body 165. For example, the flexible connectors 230 may couple with the overlay (e.g., via fasteners and/or other coupling members of the overlay).

In various implementations, any appropriate overlay may be utilized. Overlay(s) may be coupled directly to stands and/or target bodies. The overlay may be coupled via fasteners, straps, and/or frictionally coupled to the stand and/or target body. The overlay(s) may utilized with and/or without a target body. An overlay may include one or more aiming zone apertures (e.g., corresponding to a vital organ region of a set of animals) and/or markings associated with a target zone (e.g., aiming zone, bulls eye, etc.).

An overlay may be rigid and/or flexible. As illustrated in FIGS. 3, 4, 6, 7, and 8C, the overlay may be at least partially rigid. The overlay may be flexible to allow the overlay to be draped over at least a portion of the target body and/or stand. A flexible overlay may be provided on one or more rolls. The roll may include a core (e.g., paper core) and/or no core. Ends of the overlay may or may not be coupled to the roll. Since an overlay may experience more fatigue than other parts of the stand (e.g., from repeat shots, overlay material thickness, close proximity of shots which may cause a larger hole to be formed, etc.), the overlay may be replaced more frequently than the stand and/or target body. By utilizing an overlay on a roll, a worn portion of overlay may be torn away and/or rolled onto a waste roll and a new portion of the overlay may be revealed (e.g., from the roll).

In some implementations, a pattern (e.g., vital zone(s) or portion thereof, animal or portions thereof, bulls eye, target gaming, etc.) may be repeated on a length of overlay. For example, an animal skin may be printed on a length of overlay. In some implementations, a vital area (e.g., corresponding to an aiming zone) may be repeated as a pattern along a length of the overlay. The length of overlay may be rolled. In some implementations, different pattern(s) may be positioned along a length of the overlay. For example, an overlay may include a first pattern that may include a vital organ zone for a first animal, a second pattern that may include a vital organ zone for a second animal, and/or one or more other third patterns. A user may select which portion of the overlay that a user would like to utilize and roll and/or unroll the roll of overlay to reveal the selected pattern.

In some implementations, a first end of an overlay may be rolled on a first roll and a second end of the overlay may be rolled on a second roll. The overlay may extend between the two rolls. When a first portion of the overlay is worn or a user otherwise opts, a second portion of the overlay may be unrolled from the first roll and the first portion may be rolled around the second roll.

Figure 17A:
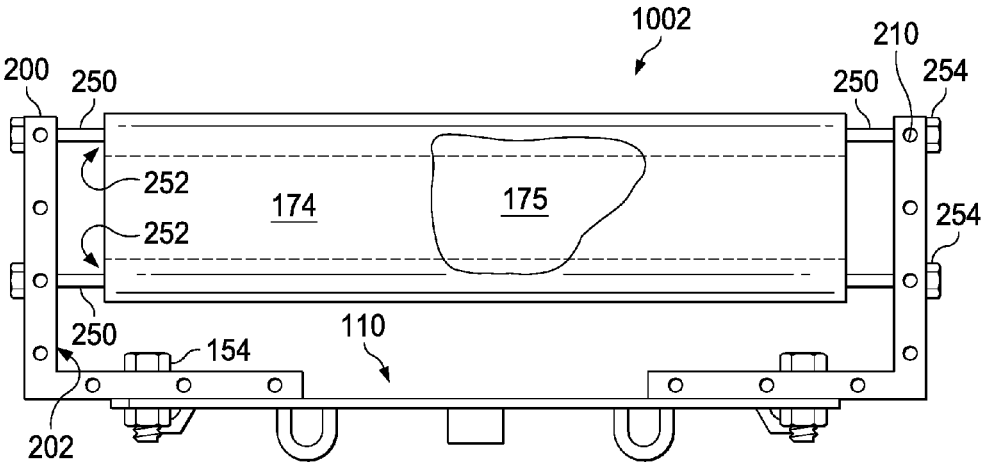
FIG. 17A illustrates a front view of an implementation of an example upper portion of a target.

FIG. 17A illustrates an implementation of an upper portion 1002 of a target with a flexible overlay 174. The flexible overlay 174 may include at least one pattern. As illustrated, the pattern may include an aiming zone 175 (e.g., vital organ zone). For example, the pattern may be printed, formed or otherwise disposed on the flexible overlay. One or more patterns may be singularly or repeatedly printed along a length of the overlay. The flexible overlay 174 may be rolled around rolls 252. A roll 252 may include an opening through the width (e.g., dimension in the parallel to the support length) of the roll. A roll may be coupled to the bracket 200 that is coupled to the support 110. A connector 250 may be disposed through the opening in the roll 252. A connector 250 may be any appropriate shape and/or size. The connector may be rigid such that the roll and/or forces applied to the roll (e.g., shots, force from rotation, etc.) may be supported. For example, a connector may include a rod. The connector 250 may be coupled proximate each end to the bracket 200. As illustrated, a fastener 254 may couple the connector 250 to the bracket via one or more openings 210 in the bracket. A first portion of the overlay 174 may be exposed to a user. The first portion of the overlay 174 may be rolled onto the second roll to expose a second portion of the overlay from the first roll.

In some implementations, a roll may be rotated a first direction to release overlay from the roll and/or may be rotated in a second opposing direction to wrap overlay onto the roll. Rotation of the roll may be manual and/or automated. For example, a user may rotate the overlay, the roll, the fastener, and/or the connector. In some implementations, one or more motorized rotation members may be coupled to the stand to rotate the connector 250 and/or roll 252 of the overlay 174. For example, a motor may be coupled to the connector and/or fastener. Actuation of the motor may be performed directly (e.g., button on the support and/or motor) and/or remotely (e.g., via a cell phone activation of a motor, remote switch, etc.).

In some implementations, more than one overlay may be utilized with the stand. For example, two or more flexible overlays may be utilized with the stand. A first flexible overlay may be coupled to a first position on the bracket and one or more second overlays may be coupled to second positions. By utilizing more than one overlay, overlays may be replaced as desired (e.g., worn, new pattern, etc.) rather replacing the entire overlay. In some implementations, games may be organized and/or played by utilizing multiple overlays. For example, target zones associated with overlays may be identified and scored based on the different overlays.

Figure 17B:
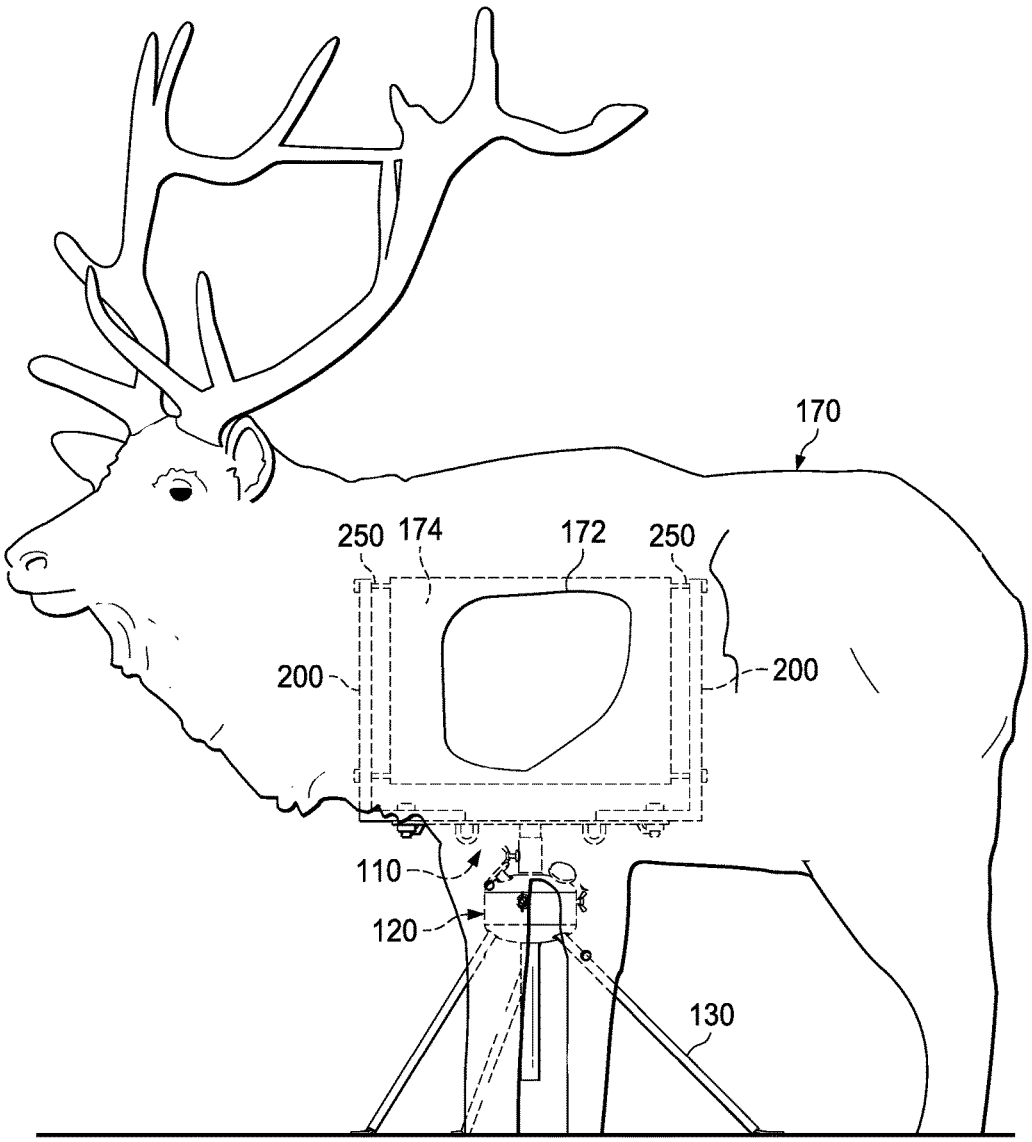
FIG. 17B illustrates a front view of an implementation of an example target that includes the upper portion illustrated in FIG. 17A.

As illustrated in FIG. 17B, a flexible overlay 174 may be utilized in conjunction with a rigid overlay 170. A stand may include a support 110, a base 120, and legs 130 to support a target body. Bracket(s) 200 may be coupled to the support 110. A flexible overlay 174 with at least one aiming zone 172 may be coupled to the bracket 200. The flexible overlay 174 may be disposed on a roll. At least one connector 250 may couple the roll to the bracket 200 via openings 210. A target body may or may not be coupled to the stand. A second overlay 170 may be coupled to the stand, flexible overlay, and/or target body. The second overlay 170 may be free standing in some implementations. The second overlay 170 may include an aiming zone aperture, in some implementations. The flexible overlay 174 may be disposed proximate the aiming zone aperture of the second overlay 170. For example, the flexible overlay may be accessible and/or viewable by the user via the aiming zone aperture of the second overlay. In some implementations, the second overlay 170 may represent an animal or portion thereof and the flexible overlay may be associated with the vital organ region of the animal. For example, the flexible overlay may include a pattern for the vital organ region of the animal in the second overlay. The pattern or a portion thereof may be accessing and/or viewable through the aiming zone on the second overlay (e.g., the aiming zone aperture and the flexible overlay may be aligned such that an arrow or ammunition strikes the flexible overlay through the aiming zone aperture in the second overlay to strike the vital organ zone for the animal). Since often an aiming zone may receive more shots than other portions of the animal, the aiming zone on the flexible overlay may be replaced without replacing the entire animal (e.g., second overlay 170). The target body (e.g., for arrows and/or ammunition) may be aligned such that when the flexible overlay or a portion thereof is struck (e.g., aiming zone of the flexible overlay, aiming zone aperture, and/or regions proximate the aiming zone and/or aiming zone aperture), the target body may also be struck (e.g., by the arrow and/or ammunition).

In some implementations, the orientation (e.g., height, angle, etc) of the stand may be adjusted such that a region of the second overlay, such as the aiming zone aperture, is appropriately aligned with the flexible overlay and/or target body. For example, at least a portion of the flexible overlay and/or the target body may be accessible via the aiming zone aperture.

As illustrated, the stand may be disposed on a ground and the height of the stand may be adjusted via the legs and/or post such that the second overlay 170 is disposed in a predetermined position (e.g., such that the animal appears to be standing on the ground).

Figure 17C:
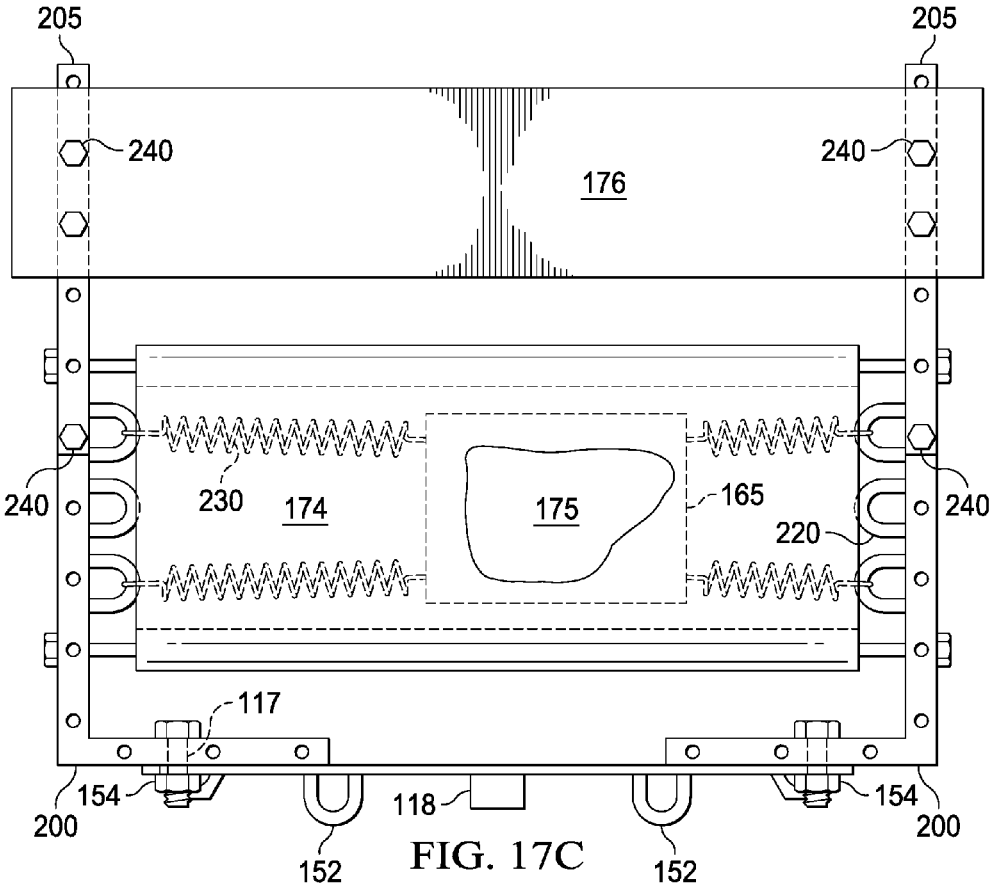
FIG. 17C illustrates a front view of an implementation of an example upper portion of a target.

As illustrated in FIG. 17C, a flexible overlay 174 may be utilized in conjunction with a second overlay 176. A length of flexible overlay 174 may disposed on one or more rolls. A roll of the overlay may be coupled to bracket(s) via a connector 250. The flexible overlay may include an aiming zone, as illustrated. Any appropriate target body may be disposed behind the overlay to receive ammunition and/or arrows that are shot at the aiming zone on the overlay. As illustrated, the target body 175 may be capable of receiving (e.g., inhibiting passage of) ammunition. The target body 175 may be coupled to loops of the bracket 200 via flexible connectors 230. As the overlay becomes worn, a user may reveal a new portion of the overlay and remove (e.g., cut off, roll onto a second roll, etc.).

In some implementations, a second overlay 176 may be coupled to the bracket. The second overlay 176 may include any appropriate pattern. For example, a head of an animal may be printed on the second overlay and a vital organ region may be shown on the flexible first overlay. Since fewer shots may strike the head on the second overlay than the aiming zone on the first overlay, the first overlay may be replaced (e.g., a different portion may be revealed) with or without replacing the second overlay. In some implementations, the first overlay may include an upper portion of an animal and a second overlay may include a lower portion of an animal that includes a vital organ region (e.g., aiming zone). Thus, the lower portion of the animal may be replaced by revealing a different portion of the second overlay without replacing the first overlay.

In some implementations, the ability to replace an overlay by revealing a different portion of the overlay may reduce costs and/or increase user enjoyment (e.g., ease of replacement). In some implementations, the operation costs of the target may be decreased by allowing an overall overlay for a stand to be replaced in portions (e.g., by using more than one overlay).

In some implementations, a bracket may include one or more extensions 205. Although an extension coupled to the bracket is shown in FIG. 17C, other implementations of FIG. 17C may not include extensions. Although an extension coupled to the bracket is shown in FIG. 17C, extensions may be utilized with other implementations of the support and/or bracket.

Figure 17D:
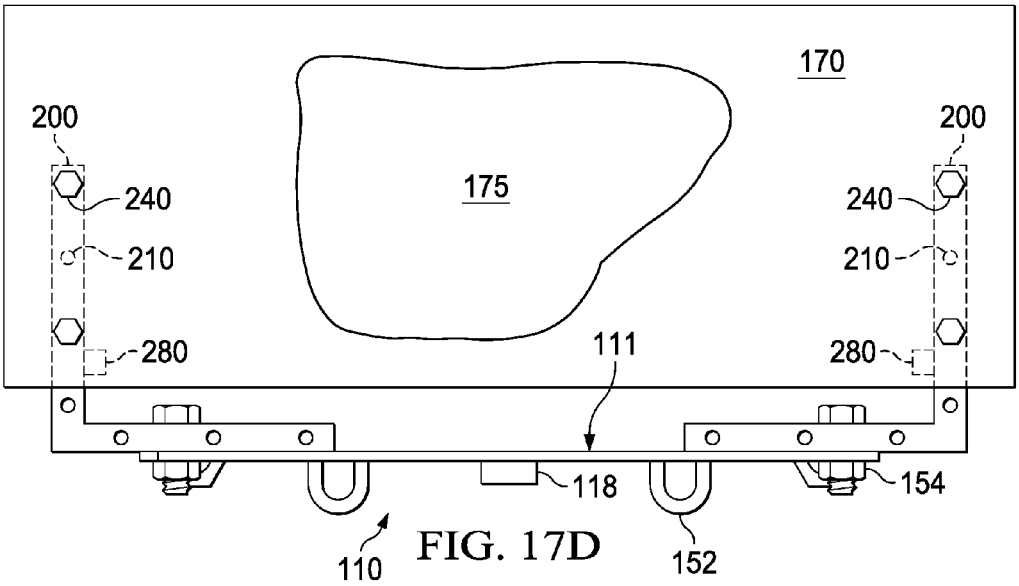
FIG. 17D illustrates a front view of an implementation of an example overlay coupled to a support of a stand.

The overlays may be utilized with any appropriate target and/or target stand. In some implementations the overlay may be utilized with or without a target body. FIG. 17D illustrates an implementation of an example of an overlay coupled to a support without a target body. As illustrated, the overlay 170 may include an aiming zone 175. The aiming zone 175 may include any appropriate aiming zone such as a vital organ zone, target zone, etc. The overlay may be rigid (e.g., sufficiently rigid to allow the overlay to resist bending when coupled to a target body and/or stand), in some implementations. As illustrated, the overlay may be coupled proximate each end to the bracket. A fastener 240 may be disposed through the overlay 170 and be disposed at least partially through an opening 210 in the bracket. In some implementations, more than one fastener may be utilized to couple the overlay to the bracket.

Figure 18A:
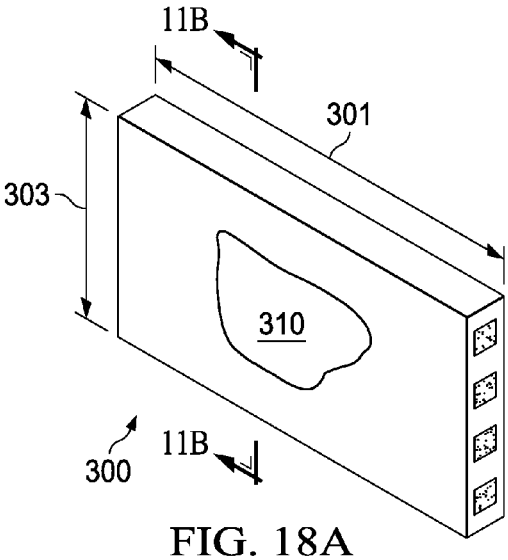
FIG. 18A illustrates a front perspective view a perspective view of an example overlay.
Figure 18B:
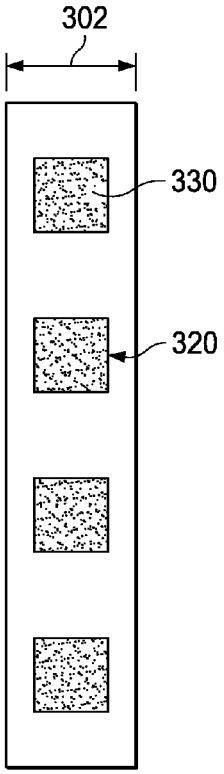
FIG. 18B illustrates a cross-sectional view of the example overlay illustrated in FIG. 18A.

In some implementations, an overlay may be capable of providing an indicator that the overlay has been punctured (e.g., by ammunition and/or arrow). FIG. 18A illustrates an implementation of an example overlay 300. The overlay 300 includes a length 301, a width 302, and a height 303. The overlay may have any appropriate size and/or shape. For example, the overlay may have a size and/or shape to at least partially cover a side (e.g., front side and/or back side) of a target or portion thereof, as the implementation illustrated in FIG. 7. In some implementations, the overlay may have a shape similar to an animal or portion thereof. For example, an overlay may include a region similar in shape to a vital organ region 310 of a set of animals. The vital organ region of the overlay be one or more apertures with similar shape(s) and/or sizes to vital organ region(s) of a set of animals.

In some implementations, a vital organ region of an overlay may be visible or invisible to a user. For example, the vital organ region may be associated with a predetermined indicator, which is released when the vital organ region of the overlay is stuck. The vital organ region may not be marked on a surface of the overlay, but when the vital organ region is struck a user may be able to identify it based on the release of a predetermined indicator, in some implementations. For example, when a user strikes the vital organ region, a first color indicator is released and when a user strikes a different region of the overlay the first color indicator may not be released (e.g., no indicator or a different indicator may be released).

In some implementations, the overlay 300 may include channels 320. The channels may be bores in the body of the overlay. The channels 320 may disposed in the overlay in any appropriate pattern. For example, the channels may be disposed in the overlay and disposed approximately planar with a surface of the overlay. One or more channels may be disposed in the overlay and approximately parallel to a width and/or length, and/or height of the overlay. The channels may be disposed at an angle to the width, length, and/or height. In some implementations, the channels may include pockets disposed in the overlay.

In some implementations, the overlay may include an indicator filling 330. The indicator filling may enhance visibility of shots (e.g., to facilitate identification of a location of a rifle shot) and/or may enhance user enjoyment. The indicator filing may include any appropriate burst pack, splatter pack, colored powered, colored fluid, and/or combinations thereof. The indicator filing may be disposed in one or more of the channels. For example, a channel (e.g., a filled channel) may be at least partially filled with indicator filling. A channel may include the same and/or different indicator fillings in different portions of the channel. For example a channel may include barriers (e.g., wall, membrane, separator, etc.) that separate different indicator fillings in different portions of the channel. When a shot (e.g., arrow or ammunition) strikes the overlay, a channel may at least partially rupture. Indicator filing 330 in the channel may be at least partially released to form a notification 335 proximate a front surface 340 of the overlay 300. The notification may be a color change, in some implementations. For example, the release of indicator filing may cause an area on the overlay to become discolored (e.g., from the indicator filing contacting the overlay).

In some implementations, an overlay may include one or more different indicator filings. For example, the overlay may include zones, which are regions of the overlay. Regions in the overlay may include different indicators. For example, a first zone may include a first indicator filing and one or more other zones of the overlay may include a second indicator filing. For example, a vital organ region (e.g., aiming zone) of the overlay may include a first indicator and an area outside the vital organ region (e.g., miss zones) may include one or more second indicator filings that have different color(s) than the first indicator filing. Thus, a user may be able to quickly identify where a shot struck the target based on the color of the indicator filing released (e.g., via the notification on the front surface of the overlay).

In some implementations, an overlay may include more than one zone. For example, regions of the overlay may be associated with a zone. One or more of the zones may be associated with a first indicator, and other zones may be associated with another indicator (e.g., second indicator). The first indicator may have a different color than one or more other indicators. For example, each zone and/or each set of zones may be associated with a different color indicator than other zones and/or sets of zones. In some implementations, a game may be scored based on colors released when the overlay is struck. For example, a first set of zones (e.g., one or more zones) may be associated with a first point value and a second set of zones may be associated with a second point value. The overlay may include one or more other zones associated with the same or different point values. One or more of the zones may be associated with one or more different colors than one or more other zones, which may facilitate scoring (e.g., from easy identification of the struck zone by the indicator being released).

In some implementations, zones may be generated in an overlay using channels that do not extend from one end of the overlay to another (e.g., using shorter channels than the height of the overlay to maintain indicator filling in a region of the overlay). In some implementations, channels may include barriers that create separate portions. Each portion may be filled with different or the same indicator.

EXAMPLES

Example 1

Figure 5:
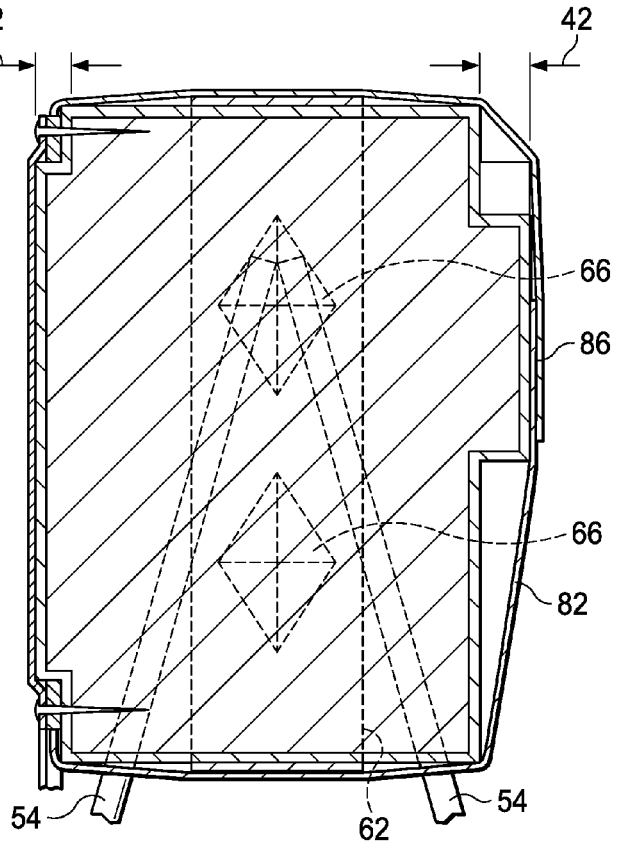
FIG. 5 illustrates a cross-section taken along line 5-5 of an implementation of the example archery target illustrated in FIG. 4.

For example, a user may select a replaceable overlay may be size and/or shaped in the form of a large game animal. FIG. 3 illustrates a partially exploded view of an archery target. FIG. 4 illustrates a front perspective view of an implementation the archery target in FIG. 3, and FIG. 5 illustrates a cross-section at line 5-5 of the implementation of the example archery target illustrated in FIG. 4. As illustrated, the replaceable overlay 74 is shaped similar to a large deer. The overlay may include an aiming zone aperture 78 corresponding with the size and location of a deer's vital organs. The large deer overlay 74 may include a strap 82 to couple the overlay 74 to the target body 14.

The target body 14 may be supported upon the mounting frame 50 in a variety of positions based at least partially on user preferences for the type of animal with which to practice. For example, the user (e.g., bow hunter) may choose to practice marksmanship skills for deer hunting. For this type of practice, the target body 14 may be positioned in a landscape orientation and placed in an elevated position upon the mounting frame 50 utilizing mounting pockets 66. Also, the target body 14 is oriented with the aiming zone 34 facing the bow hunter to serve as the active target. With the target body 14 positioned and oriented as such, the height and orientation of the aiming zone 34 corresponds with the vital organs of a large deer. As shown in FIGS. 3-5, the large deer overlay 74 may be secured to the target body 14 by passing the protruding aiming zone 34 through the apeliure 78 and securing the large deer overlay 74 to the target body 14 by use of strap 82 which may be wrapped over the target body 14 and attached to itself by various suitable mechanisms (e.g., a hook and loop fastening system 86 such as Velcro®).

The target body 14 may be supported above the ground 4 by utilization of a mounting frame 50. In some implementations, the target body 50 may be positioned directly upon the ground.

Example 2

In some implementations, the user (e.g., bow hunter) may choose to practice marksmanship skills for elk hunting. FIG. 7 illustrates an implementation of an example archery target. The replaceable overlay is shaped in the form of a large elk 90, and includes an aperture that is located and shaped to correspond with a large elk's vital organs. The replaceable overlay 90 may be shaped in the form of other large game animals including but not limited to moose, lions, bears, and buffalo. For this type of target practice, the target body 14 may be positioned in a portrait orientation and placed upon the mounting frame 50 in the elevated position, as shown in FIG. 7. Also, the target body 14 is oriented with the aiming zone 34 serving as the active target. With the target body 14 positioned and oriented as such, the height and orientation of the aiming zone 34 corresponds with the vital organs of a large elk. The large elk overlay 90 may be secured to the target body 14 utilizing a strap m a similar manner to that described above.

Example 3

In some implementations, the user (e.g., bow hunter) may choose to practice marksmanship skills for hunting raccoon. Referring now to FIG. 6, as the raccoon is a small game animal, the support frame 50 may be dispensed with entirely and the target body 14 may be placed directly upon the ground 4. For this application the target body 14 is reversed so that the aiming zone 38 for small game animals serves as the active target. With the target body 14 positioned and oriented as such, the height and location of the aiming zone 38 corresponds with the vital organs of a small raccoon. In this manner, the small raccoon overlay 94 may be secured to the target body 14 in similar manner as discussed above. In some implementations, the replaceable overlay may be shaped in the form of other small game animals including but not limited to foxes, turkeys, coyotes, raccoons, or javalinas, etc. In accordance with the present invention, as described above, the target body 14 may be elevated, lowered, oriented in portrait or landscape positions, and/or rotated to utilize either aiming 34 or 38 to match the vital organs of various game animals.

End of Examples

Although implementations have described the archery target as being struck by an arrow, other pointed projectiles may be used with the described systems and processes, as appropriate.

Although implementations have described that the archery target includes a body coupled to a mounting frame and/or overlay, the target body may be utilized without the mounting frame (e.g., directly on the ground, with other mounting frames, with 3D replicas, etc.). In some implementations, the target body may or may not be coupled with an overlay.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "an aiming zone" includes a combination of two or more aiming zones and reference to "a foam" includes different types and/or combinations of foams.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A target comprising:

a target mounting frame, wherein the target mounting frame comprises:

a target support member comprising:

a first surface, wherein the first surface comprises a first end and an opposing second end;

an opposing second surface, wherein the second surface comprises:

a post coupling member disposed on the second surface, wherein the post coupling member allows a post adapted to extend the height of the frame to be coupled to the target support member;

one or more strap coupling members extending from the second surface, wherein each strap coupling member comprises an aperture to allow a strap to couple with the strap coupling member, and wherein the strap is adapted to couple a target body to the target support member; and a first side disposed between the first surface and the second surface of the target support member;

at least two leg coupling members disposed on the first side; wherein each of the leg coupling members is capable of receiving a section of the post; and wherein a first leg coupling member is disposed proximate a first end of the first surface and wherein a second leg coupling member is disposed proximate a second end of the first surface;

wherein the target support member is capable of supporting at least one of a target body or an overlay in at least a first position and a second position;

and wherein the target support member is configured such that, in a first position, two or more of the at least two leg coupling members receive sections of the post; and wherein, in the first position, the target support member is configured such that at least a portion of a side of each section of the post received by the one or more of the leg coupling members and at least a portion of one or more of the strap coupling members contacts a surface on which the target mounting frame is disposed;

and wherein the target support member is configured such that in a second position the post coupling member receives the post coupled to a base; and wherein the base is coupled to a set of legs; and wherein, in the second position, a second opposing end of each leg of the set of legs contacts the surface.

2. The target mounting frame of claim 1 further comprising;

a post coupled to the target support member via the post coupling member;

a base, wherein the base comprises a brace, wherein the brace comprises a post opening adapted to receive at least a portion of the post to couple the post and the base of the frame;

at least three apertures disposed at an angle relative to the target support member, wherein each aperture is adapted to receive one of the legs of the frame; and at least three legs, wherein each leg is disposed at least partially in the aperture, and wherein each leg comprises:

a first end disposed proximate the base; and an opposing second end adapted to contact the surface on which the frame is disposed.

3. The target mounting frame of claim 2 further comprising more than one anchoring loop, wherein each anchoring loop is disposed proximate the second end of at least one of the legs, and wherein the anchoring loops are adapted to couple with an anchor disposed in the surface on which the frame is disposed to inhibit movement of the frame.

4. The target mounting frame of claim 2 wherein the height of the post is adjustable by adjusting the position of the post in the brace.

5. The target mounting frame of claim 2 wherein the height of the frame is adjustable by adjusting the position of the legs in the leg openings in the base, and wherein the angle of the leg openings inhibits movement of the legs from the weight of the frame.

6. The target mounting frame of claim 2 further comprising:

at least three fastener openings, wherein each fastener opening extends through the base into one of the leg apertures; and at least three first fasteners, wherein each first fastener is disposed in one of the fastener openings such that an end of the first fastener contacts at least one of the legs in a leg opening to inhibit adjustment of the height of the frame by adjusting the height of the leg; and a second fastener disposed in an opening extending through the brace into the post opening, wherein the second fastener contacts the post to inhibit adjustment of a height of the frame by adjusting the height of the post.

7. The target mounting frame of claim 2 wherein the base comprises a first end and an opposing second end, wherein the second end is more proximate a surface on which the frame is disposed than the first end, and wherein the brace comprises a conduit that extends through the base such that the brace extends from the first end of the base and extends from the second end of the base.

8. The target mounting frame of claim 2 wherein the target mounting frame is self leveling.

9. The target of claim 1 further comprising a target overlay coupled atop the target mounting frame, wherein the target overlay comprises:

a first surface;

an opposing second surface;

a plurality of channels disposed between the first surface and the second surface, wherein at least one of the channels comprises a filled channel;

an indicator filling disposed in at least one of the filled channels;

at least one aiming zone with a shape similar to at least one vital organ wherein the overlay releases at least a portion of the indicator filing when at least one of an arrow or ammunition ruptures at least a portion of at least one of the filled channels, and wherein at least a portion of the target overlay comprises a shape similar to at least a portion of one or more animals.

10. The target of claim 1 further comprising:

a target body disposed on the target support member, wherein the target body comprises:

a width disposed between a first end and a second opposing end;

the first end comprising a first surface, wherein the first surface comprises:

a first central axis perpendicular to the width of the target body; and a first aiming zone disposed off center with respect to the first central axis of the first surface, wherein the first aiming zone corresponds with a first set of animals, wherein the first set of animals includes more than one first animal; and the second end comprising a second surface; wherein the second surface comprises:

a first central axis perpendicular to the width of the target body; and a second aiming zone disposed off-center with respect to the first central axis of the second surface, wherein the second aiming zone corresponds to a second set of animals, wherein the second set of animals includes more than one second animal.

11. The target of claim 10 wherein the target body comprises more than one position, and wherein at least two of the positions comprise:

a first position, wherein when the target body is disposed in the first position the first aiming zone is associated with a first subset of animals, and wherein the first subset of animals comprises a first portion of the first set of animals; and a second position, wherein when the target body is disposed in the second position the first aiming zone is associated with a second subset of animals, and wherein the second subset of animals comprises a second portion of the first set of animals that is different from first subset of animals, and wherein the target body is rotated from the first position to the second position.

12. The target of claim 10 wherein the first aiming zone corresponds to a vital organ region associated with the first set of animals, and wherein the second aiming zone corresponds to a vital organ region associated with the second set of animals.

13. A target system comprising:

a target mounting frame, wherein the target mounting frame comprises:

a target support member comprising:

a first surface, wherein the first surface comprises a first end and an opposing second end;

an opposing second surface, wherein the second surface comprises:

a post coupling member disposed on the second surface, wherein the post coupling member allows a post adapted to extend the height of the frame to be coupled to the target support member;

one or more strap coupling members extending from the second surface, wherein each strap coupling member comprises an aperture to allow a strap to couple with the strap coupling member, and wherein the strap is adapted to couple a target body to the target support member; and a first side disposed between the first surface and the second surface of the target support member;

at least two leg coupling members disposed on the first side; wherein each of the leg coupling members is capable of receiving a section of the post; and wherein a first leg coupling member is disposed proximate a first end of the first surface and wherein a second leg coupling member is disposed proximate a second end of the first surface;

wherein the target support member is capable of supporting at least one of a target body or an overlay in at least a first position and a second position;

and wherein the target support member is configured such that, in a first position, two or more of the at least two leg coupling members receive sections of the post; and wherein in the first position, the target support member is configured such that at least a portion of a side of each section of the post received by the one or more of the leg coupling members and at least a portion of one or more of the strap coupling members contacts a surface on which the target mounting frame is disposed;

and wherein the target support member is configured such that in a second position the post coupling member receives the post coupled to a base; and wherein the base is coupled to a set of legs; and wherein, in the second position, a second opposing end of each leg of the set of legs contacts the surface; and an overlay.

14. The target mounting frame of claim 13 wherein the target support member comprises:

a first brace opening disposed proximate the first end of the first surface;

a second brace opening disposed proximate the second end of the first surface;

wherein the frame further comprises a first bracket and a second bracket; wherein the first bracket comprises a plurality of coupling openings extending along the first bracket; and the second bracket comprises a plurality of coupling openings extending along the second bracket.

15. The target mounting frame of claim 14 further comprising:

a flexible overlay comprising:

a length; and one or more patterns, wherein one or more of the patterns is disposed on the length of the flexible overlay;

a first roll, wherein the first roll comprises an opening disposed through the length of the first roll, and wherein the flexible overlay is capable of wrapping around the first roll;

a first connector disposed through the opening of first roll, wherein a first end of the first connector is coupled to the first bracket via at least one of the coupling openings, and wherein a second end of the first connector is coupled to the second bracket via at least one of the coupling openings;

a second roll, wherein the second roll comprises an opening disposed at least partially through the length of the second roll, and wherein the flexible overlay is capable of wrapping around the second roll;

a second connector disposed through the opening of second roll, wherein a first end of the second connector is coupled to the first bracket via at least one of the coupling openings, and wherein a second end of the second connector is coupled to the second bracket via at least one of the coupling openings;

and wherein the first roll and the second roll are capable of rotating to allow at least one of:

unwrapping at least a first portion of the flexible wrap from the second roll and wrapping at least a second portion of the flexible overlay around the first roll;

or unwrapping at least a first portion of the flexible overlay from the first roll and wrapping at least a second portion of the flexible overlay around the second roll.

16. The target mounting frame of claim 15 further comprising an additional overlay, wherein the additional overlay has a shape similar to at least a portion of an animal, and wherein the additional overlay comprises an aiming zone aperture, and wherein at least a portion of the flexible overlay is accessible via the aiming zone aperture.

17. The target mounting frame of claim 14 further comprising an overlay, wherein the overlay is coupled to the first bracket via one or more of the coupling openings of the first brace, and wherein the overlay is coupled to the second brace via one or more of the coupling openings of the second bracket.

18. The target mounting frame of claim 13 wherein the target support member comprises:

a first brace opening disposed proximate the first end of the first surface;

a second brace opening disposed proximate the second end of the first surface;

wherein the frame further comprises a first bracket and a second bracket; wherein the first bracket comprises a plurality of coupling openings extending along the first bracket; and the second bracket comprises a plurality of coupling openings extending along the second bracket and further comprising:

a target body capable of inhibiting passage through the target body of at least one of an arrow or ammunition; and two or more flexible connectors, wherein the target body is coupled to at least one loop of the first bracket via at least one flexible connector, and wherein the target body is coupled to at least one loop of the second bracket via at least one other flexible connector.

19. The target mounting frame of claim 13 wherein the target support member comprises:

a first brace opening disposed proximate the first end of the first surface;

a second brace opening disposed proximate the second end of the first surface;

wherein the frame further comprises a first bracket and a second bracket; wherein the first bracket comprises a plurality of coupling openings extending along the first bracket; and the second bracket comprises a plurality of coupling openings extending along the second bracket and further comprising:

a target body capable of inhibiting passage through the target body of ammunition, wherein the target body comprises a coupling member; and a rigid connector, wherein the rigid connector comprises:

a first end, wherein the first end of the rigid connector is coupled to the first bracket; and an opposing second end, wherein the second end of the rigid connector is coupled to the second bracket;

and wherein the rigid connector is coupled to the coupling member of the target body to allow rotation of the target body.

20. The target of claim 13 wherein the overlay has a shape similar to at least a portion of an animal, and wherein the overlay comprises an aiming zone.

21. The target of claim 13 wherein the aiming zone comprises an aperture.

22. The target of claim 13 wherein the aiming zone is replaceable.

23. The target of claim 13 wherein the aiming zone corresponds to a vital organ region associated with the first set of animals.

* * * * *